US008950385B1

(12) United States Patent
Khoshnood

(10) Patent No.: US 8,950,385 B1
(45) Date of Patent: Feb. 10, 2015

(54) CROSSBOW WITH A CRANK COCKING AND RELEASE MECHANISM

(71) Applicant: Bahram Khoshnood, Cumming, GA (US)

(72) Inventor: Bahram Khoshnood, Cumming, GA (US)

( * ) Notice: Subject to any disclaimer, the term of this patent is extended or adjusted under 35 U.S.C. 154(b) by 0 days.

(21) Appl. No.: 14/332,041

(22) Filed: Jul. 15, 2014

Related U.S. Application Data

(63) Continuation of application No. 14/288,071, filed on May 27, 2014.

(51) Int. Cl.
*F41B 5/18* (2006.01)
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)
USPC ..... 124/25; 124/1; 124/86; 124/88; 124/90

(58) Field of Classification Search
CPC ..... F41B 5/1469; F41B 5/123; F41B 5/12
USPC ..... 124/1, 25, 86, 88, 90
See application file for complete search history.

(56) References Cited

U.S. PATENT DOCUMENTS

| | | | | |
|---|---|---|---|---|
| 6,095,128 | A * | 8/2000 | Bednar | 124/25 |
| 6,286,496 | B1 * | 9/2001 | Bednar | 124/25 |
| 6,799,566 | B1 * | 10/2004 | Malucelli | 124/25 |
| 6,874,491 | B2 * | 4/2005 | Bednar | 124/25 |
| 6,913,007 | B2 * | 7/2005 | Bednar | 124/25 |
| 7,100,590 | B2 * | 9/2006 | Chang | 124/25 |
| 7,174,884 | B2 * | 2/2007 | Kempf et al. | 124/25 |
| 7,784,453 | B1 * | 8/2010 | Yehle | 124/25 |
| 7,810,480 | B2 * | 10/2010 | Shepley et al. | 124/25 |
| 8,104,461 | B2 * | 1/2012 | Kempf | 124/25 |
| 8,240,299 | B2 * | 8/2012 | Kronengold et al. | 124/25 |
| 8,375,928 | B1 * | 2/2013 | Bednar et al. | 124/25 |
| 8,439,025 | B2 * | 5/2013 | Shaffer et al. | 124/25 |
| 8,443,790 | B2 * | 5/2013 | Pestrue | 124/25 |
| 8,453,631 | B1 * | 6/2013 | Kronengold et al. | 124/25 |
| 8,469,012 | B2 * | 6/2013 | Bednar et al. | 124/25 |
| 8,479,719 | B2 * | 7/2013 | Bednar et al. | 124/25 |
| 8,499,753 | B2 * | 8/2013 | Bednar et al. | 124/25 |
| 8,578,917 | B2 * | 11/2013 | Bednar et al. | 124/25 |
| 2004/0194771 | A1 * | 10/2004 | Malucelli | 124/25 |
| 2005/0022799 | A1 * | 2/2005 | Bednar | 124/25 |
| 2009/0277435 | A1 * | 11/2009 | Pestrue | 124/25 |
| 2010/0170488 | A1 * | 7/2010 | Rasor et al. | 124/25 |
| 2012/0204849 | A1 * | 8/2012 | Bednar et al. | 124/25 |
| 2013/0125868 | A1 * | 5/2013 | Bednar et al. | 124/25 |
| 2013/0298890 | A1 * | 11/2013 | Bednar et al. | 124/25 |

* cited by examiner

*Primary Examiner* — Gene Kim
*Assistant Examiner* — Alexander Niconovich
(74) *Attorney, Agent, or Firm* — Brient Globerman, LLC

(57) ABSTRACT

A crossbow bowstring drawing mechanism comprises (1) a generally cylindrical housing having a first end and a second end; (2) a shaft rotatably mounted in the housing has a first end that at least partially extends through the housing first end; (3) at least one rope spool received on, and rotationally fixed to, the shaft intermediate the shaft first and second ends; (4) a handle operatively coupled to the shaft; and (5) a clutch mechanism received on the shaft. At least one of the rope spools is configured to attach to a first and a second end of a rope that is configured to be releasably attached to a bowstring. The clutch mechanism is configured to at least temporarily rotationally fix the shaft to the housing to prevent the shaft from rotating in a first direction and an opposite second direction until a force is exerted on the handle to overcome the frictional forces exerted by the clutch mechanism.

25 Claims, 19 Drawing Sheets

CROSSBOW WITH A CRANK COCKING AND RELEASE MECHANISM

PRIORITY CLAIM

This application is a continuation of U.S. patent application Ser. No. 14/288,071, filed May 27, 2014, and entitled "Crossbow with a Crank Cocking and Release Mechanism," the entire disclosure of which is incorporated by reference herein.

BACKGROUND

The present invention relates generally to crossbows and in particular to a release mechanism for cocking and un-cocking the bowstring on a crossbow.

Crossbows have been used since the middle ages. Crossbows have evolved to include cams and synthetic split limbs that greatly increase firing velocity. Because of the increased forces exerted by the limbs, cranks have been used to cock the bowstring. One problem encountered when using a crank mechanism to cock the bowstring arises when the user wishes to disconnect the cranking mechanism from the bowstring. Moreover, increased firing velocity also creates a problem when a crossbow is dry-fired in order to release the bowstring from a cocked position into an un-cocked position without firing a bolt or arrow. Unloaded or dry firing impacts can damage the bowstring, limbs, cams and other components. Dry firing also creates a safety concern. The designs disclosed herein seek to address many of the concerns that arise with today's crossbows.

SUMMARY OF THE INVENTION

In one embodiment, a bowstring drawing mechanism for use on a weapon comprises (1) a generally cylindrical housing; (2) a shaft; (3) a ratchet wheel that has a toothed outer circumferential surface and a splined inner circumferential surface; (4) at least one rope spool received on, axially moveable with respect to, and rotationally fixed to, the shaft; (5) a clutch mechanism received on the shaft intermediate the shaft threaded second end and the shaft axial splines; and (6) a handle operatively couple to the shaft. The shaft has (1) a first end; (2) a threaded second end; (3) an axis extending between the first and second ends; and (4) axial splines formed on an outer circumference of the shaft intermediate the first and second ends. The axial splines of the shaft are each substantially parallel to the shaft axis. A portion of the shaft is rotatably mounted in the housing. The ratchet wheel is positioned on the shaft proximate to the first end of the shaft. The rope spool is configured to attach to a first and a second end of a rope and the rope is configured to be releasably attached to a bowstring. The clutch mechanism has splines formed on an inner circumferential surface. When the shaft is in a first axial position, with respect to the clutch mechanism and the ratchet wheel, the shaft splines are engaged with the ratchet wheel splines and are disengaged from the clutch mechanism splines so that the ratchet wheel allows the shaft to rotate in a first direction and prevents the shaft from rotating in a second opposite direction. Additionally, when the shaft is in a second axial position, with respect to the clutch mechanism and the ratchet wheel, the shaft splines are disengaged from the ratchet wheel splines and engaged with the clutch mechanism splines so that the clutch prevents the shaft from rotating in the first direction and the second direction until force is applied to the handle.

In still another embodiment, a bowstring drawing mechanism comprises (1) a generally cylindrical housing having a first end and a second end; (2) a shaft rotatably mounted in the housing has a first end that extends through the housing first end and second end; (3) at least one rope spool received on, and rotationally fixed to, the shaft intermediate the shaft first and second ends; (4) a handle operatively coupled to the shaft; and (5) a clutch mechanism received on the shaft. At least one of the rope spools is configured to attach to a first and a second end of a rope that is configured to be releasably attached to a bowstring. The clutch mechanism is configured to at least temporarily rotationally fix the shaft to the housing to prevent the shaft from rotating in a first direction and an opposite second direction until a force is exerted on the handle.

In yet another embodiment, a bowstring drawing mechanism comprises (1) a generally cylindrical housing having a first end and a second end; (2) a shaft rotatably mounted in the housing and having a first end that extends through the housing first end, and a second end; (3) a first rope spool received on, and rotationally fixed to, the shaft intermediate the shaft first and second ends; (4) a second rope spool received on, and rotationally fixed to, the shaft intermediate the first rope spool and the shaft second end; (5) a handle operatively coupled to the shaft; and (6) a clutch mechanism received on the shaft intermediate the first and second rope spools. In various embodiments, the first and second rope spools are configured to respectively attach to a first and a second end of a rope that is configured to be releasably attached to a bowstring and the clutch mechanism is configured to at least temporarily rotationally couple the shaft to the housing.

In some embodiments, the clutch mechanism further comprises a disk rotationally fixed to the shaft, a ratchet wheel rotatably received on the shaft, and a clutch plate positioned intermediate the disk and the ratchet wheel. In other embodiments, the bowstring drawing mechanism further comprises a first gear received on and rotationally fixed to the shaft and a second shaft rotatably mounted in the housing where the second shaft has a first end coupled to the handle, and a second gear rotationally fixed to the second shaft. In some of these embodiments, the first gear is operatively coupled to the second gear so that rotation of the handle in a first direction causes the second shaft and the second gear to rotate in the first direction and the first gear and the first shaft to rotate in the opposite direction.

BRIEF DESCRIPTION OF THE DRAWINGS

Various embodiments of an apparatus, system, and method for monitoring sports performance are described below. In the course of this description, reference will be made to the accompanying drawings, which are not necessarily drawn to scale, and wherein.

DETAILED DESCRIPTION

Various embodiments now will be described more fully hereinafter with reference to the accompanying drawings. It should be understood that the invention may be embodied in many different forms and should not be construed as limited to the embodiments set forth herein. Like numbers refer to like elements throughout.

Overview

Figure 1:
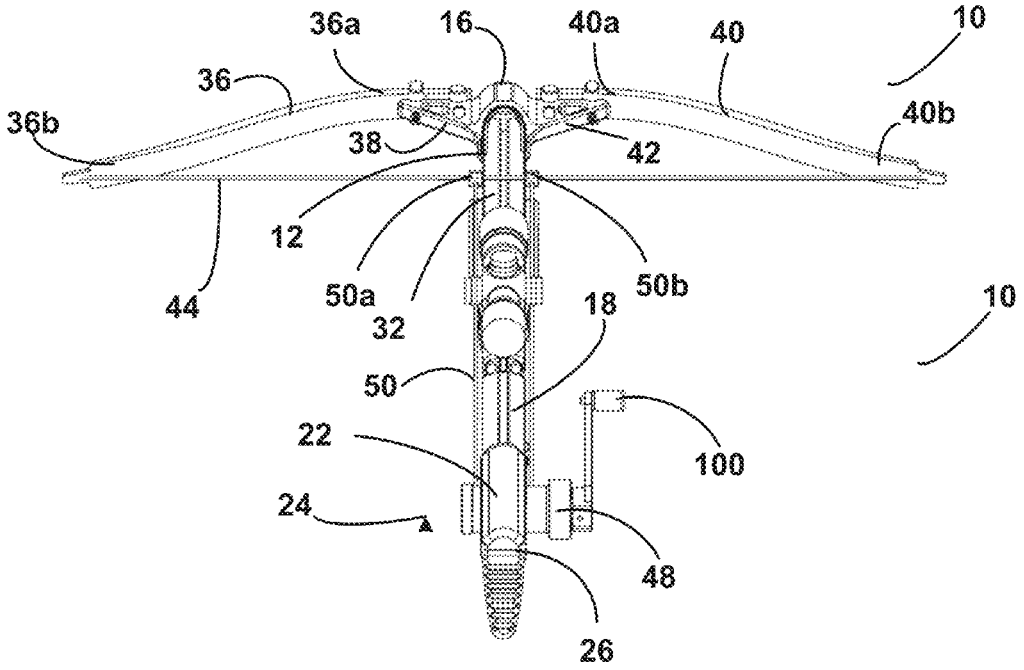
FIG. 1 is a perspective view of an embodiment of a crossbow.
Figure 2:
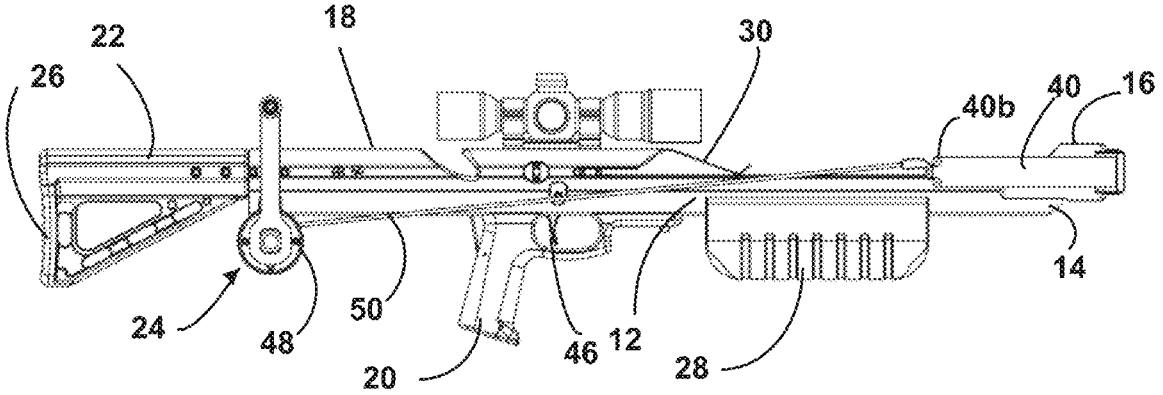
FIG. 2 is a right side plan view of the crossbow of FIG. 1.

Referring to FIGS. 1 and 2, a crossbow 10 is shown having a barrel 12 that has a first end 14 coupled to a riser 16 and a second end 18 coupled to a pistol grip 20. A stock 22 is coupled to the elongated barrel second end and terminates at a butt 26. In the embodiment shown, the stock length is adjustable, but in other embodiments the stock may have a fixed length. A grip 28 is coupled to the barrel 12 intermediate the first and second ends 14 and 18. A retention spring 30 is operatively coupled to a top surface 32 of the barrel 12. A first limb 36 has a first end 36*a* operatively coupled to a left side 38 of the riser 16 and a second end 36*b* operatively coupled to a bowstring 44. A second limb 40 has a first end 40*a* that is operatively coupled to a right side 42 of the riser 16 and a second end 40*b* that is operatively coupled to the bowstring 44. A trigger mechanism 46 is used to fire the crossbow 10 when the bowstring 44 is in a cocked position.

A bowstring cocking device 24 is releasably coupled to the bowstring 44 and contains a crank mechanism 48, an elongated cocking rope 50 having a first hook 50*a* and a second hook 50*b*. The first and second hooks 50*a* and 50*b* are configured to attach to the bowstring 44 so that when a user turns the crank 48, the cocking rope 50 pulls the bowstring 44 into a cocked position. In general, the bowstring cocking device 24 is used to move the bowstring 44 into a cocked firing position and/or to move the bowstring 44 from the cocked firing position back into a resting position without having to fire or dry fire the crossbow 10. Various embodiments use a ratchet wheel and detent to allow the crank to turn in a winding first direction while preventing the crank from turning in an unwinding second direction. In various embodiments, when a clutch in the crank is engaged and the ratchet and detent disengaged, the clutch allows the crank to rotate in the unwinding second direction in a controlled manner if the user wishes to either provide slack in the elongated cocking rope 50 to remove the first and second hooks 50*a* and 50*b* from the bowstring 44 or to move the crossbow bowstring 44 into the resting position without firing or dry firing the crossbow 10.

First Embodiment of Bowstring Cocking Device

FIGS. 3-8 illustrate a first embodiment of a bowstring cocking device 24 having a dual shaft mechanism, a ratchet wheel, and a clutch mechanism.

Bowstring Cocking Device Structure

Figure 3:
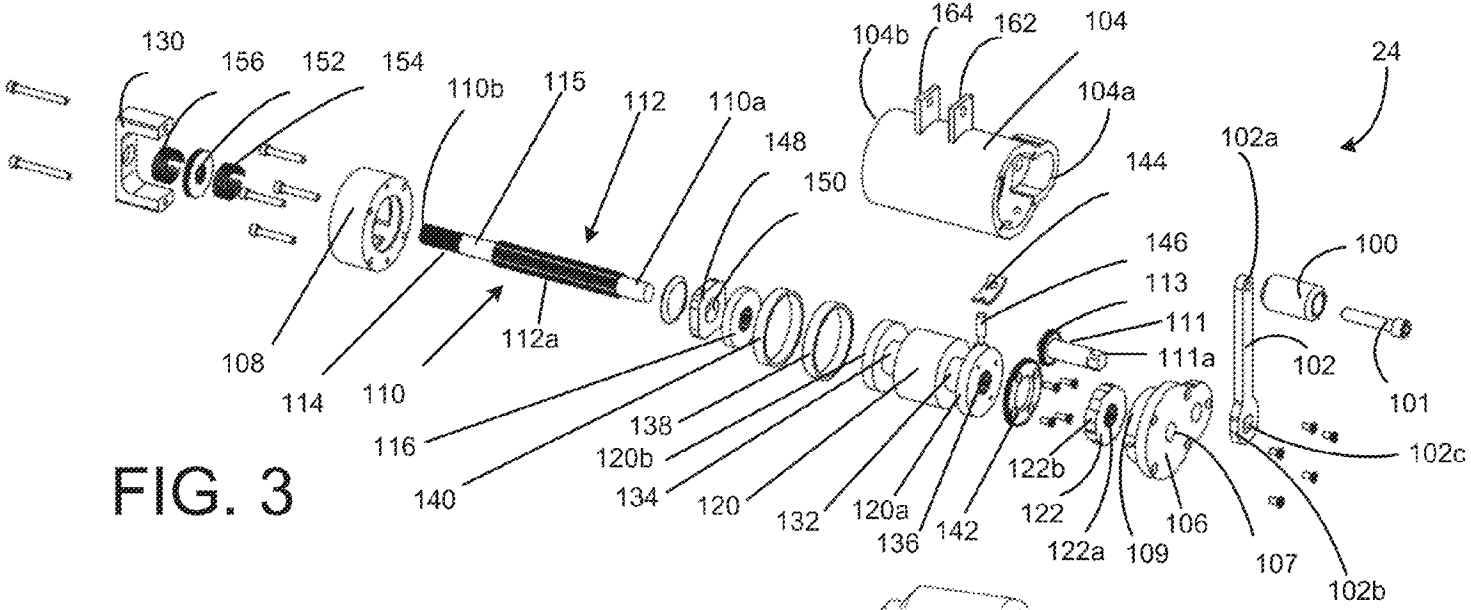
FIG. 3 is an exploded view of a bowstring cocking device for use with the crossbow of FIG. 1.
Figure 4:
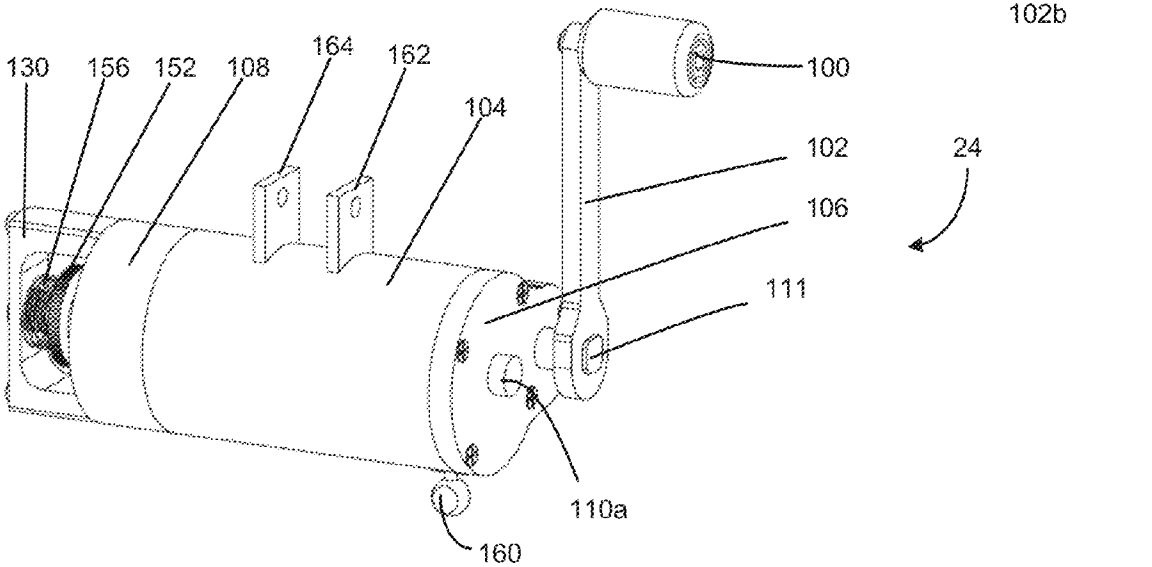
FIG. 4 is a perspective view of the bowstring cocking device of FIG. 3.

Referring to FIGS. 3 and 4, one embodiment of a bowstring cocking device 24 is shown. In particular, the bowstring cocking device 24 comprises a handle 100, a crank 102, a housing body 104 having a first and second cover 106 and 108, a shaft 110, a spool body 120, a ratchet wheel 122, a gear 142, a clutch mechanism 148, and a knob 152.

Housing Body

The first cover 106 and the second cover 108 together enclose the various parts of the bowstring cocking device 24 within the housing body 104. The housing body 104 is generally cylindrical in shape, but may be formed in any suitable shape. In various embodiments, the housing 104 may be formed from any suitable material (e.g., alloy, stainless steel, ceramic, polymers, etc.) and in particular embodiments the housing 104 is formed from aluminum. A first mounting bracket 162 and a second mounting bracket 164 are coupled to the housing body 104 at a top surface and are configured to mount the bowstring cocking device 24 to the underside of the crossbow 10, as shown in FIGS. 1 and 2. In various embodiments, the mounting brackets may be connected to the crossbow 10 using any suitable fastener (e.g., a bolt, a pin, a rivet, weldments, etc.).

Shaft

Referring to FIG. 3, the shaft 110 has a first end 110*a*, a second end 110*b* and a splined portion 112 intermediate the first and second ends 110*a* and 110*b*. In addition to the splined portion 112, a threaded shaft portion 114 is positioned proximate the shaft second 110*b*. The shaft 110 also has a smooth portion 115 positioned intermediate the splined portion 112 and the threaded portion 114. The splined shaft 110 is generally cylindrically shaped with the axial splines 112*a* formed on an outer circumference of the shaft intermediate to the first end 110*a* and the second end 110*b* where each axial spline is substantially parallel to the axis of the shaft 110.

The shaft 110 is rotatably mounted in the housing 104 so that the shaft first end 110*a* extends through a hole 107 formed through the first cover 106 and the shaft second end 110*b* extends through the second cover 108. The splines 112*a* are configured to interact with a splined ring 116, a splined inner circumference bore 136 of the rope spool body 120, and a splined inner circumferential surface 122*a* of the ratchet wheel 122. The second end 110*b* of the shaft 110 passes through the second cover 108 of the housing body 104 where the threaded end 114 is configured to receive a first spring 154, a threaded knob 152, a second spring 156, and a knob bracket 130.

Rope Spool Body

Figure 6:
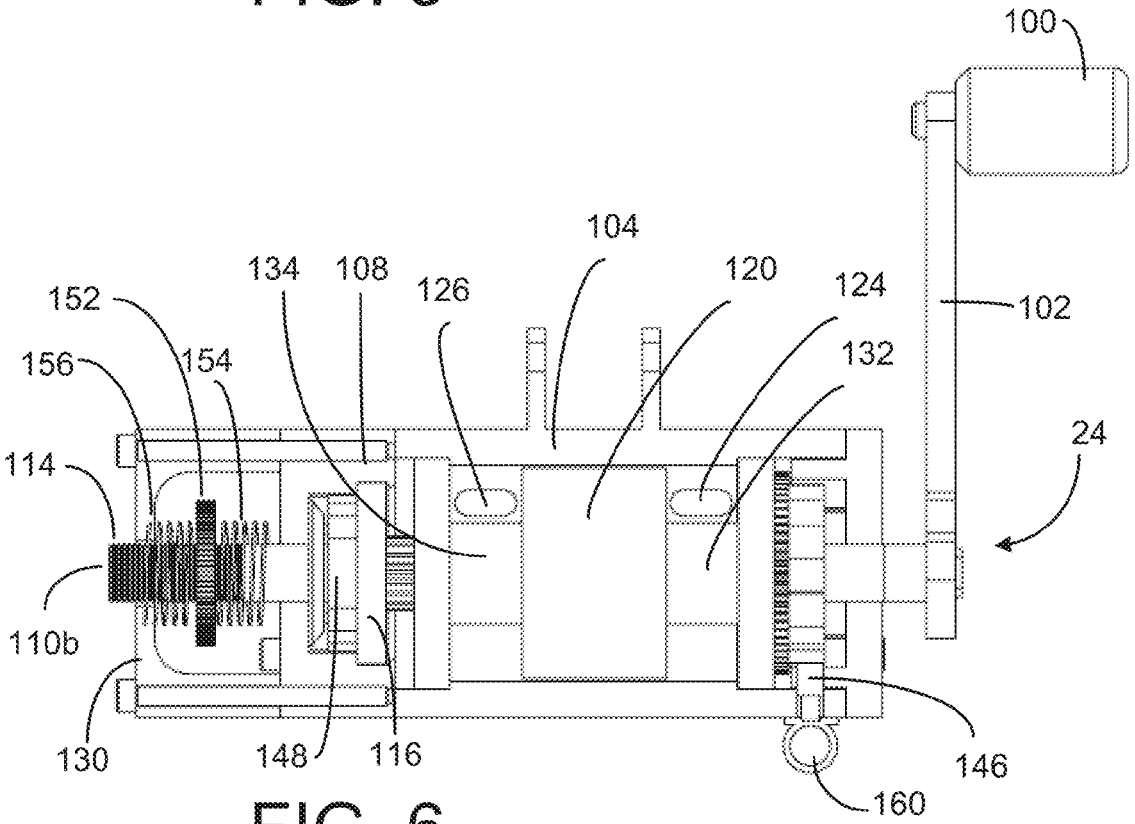
FIG. 6 is a partial sectional view of the bowstring cocking device of FIG. 3.

The rope spool body 120 comprises a first end 120*a* and a second end 120*b*. The rope spool body 120 is generally cylindrical in shape and has a first rope spool 132 and a second rope spool 134. The rope spools 132, 134 provide a space for the cocking rope 50 to wind around when the bowstring 44 is pulled from the resting position into the cocked position. The rope spool body 120 is received on, axially moveable with respect to, and rotationally fixed to the shaft 110 by the splined bore 136 formed through the rope spool body 120. In addition, the rope spools 132 and 134 are configured to operatively attach to a first and a second end of the cocking rope 50. A first bearing 138 encompasses the first end 120*a* of the rope spool body 120 and a second bearing 140 encompasses the second end 120*b*. The bearings 138, 140 help the rope spool body 120 rotate smoothly when the rope spool body 120 is rotated within the housing body 104. Referring to FIG. 6, a first opening 124 and a second opening 126 in the housing body 104 are positioned above the first rope spool 132 and the second rope spool 134, respectively, and allow the cocking rope 50 (not shown) to enter the housing body 104 and wind around the rope spools 132, 134.

Gear

Referring again to FIG. 3, the gear 142 is rotationally fixed to the first end 120*a* of the rope spool body 120 by screws (not numbered). In various embodiments, the gear 142 may be integrally formed with the rope spool body 120. In still other embodiments, the gear 142 may be rotationally fixed to the shaft 110 via a splined engagement similar to the splined engagement between the rope spool body 120 and the shaft splines 112*a*.

Ratchet Wheel and Detent

Figure 5:
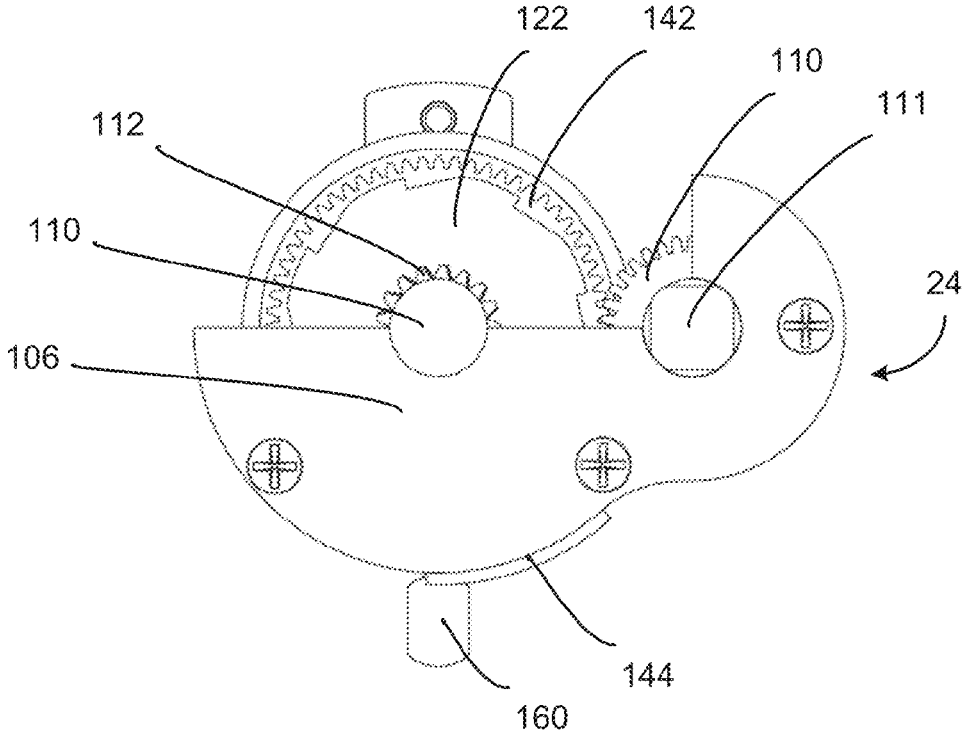
FIG. 5 is a partial sectional view of the bowstring cocking device of FIG. 3.

The first cover 106 of the housing body 104 has a circular flange 109 that defines a recess (not shown) that is configured to receive the ratchet wheel 122 therein. The ratchet wheel 122 has (1) the splined inner circumference surface 122*a* and is received on the shaft splined portion 112, and (2) a toothed outer circumferential surface 122*b*. The ratchet wheel 122 is positioned on the shaft 110 proximate to the shaft first end 110*a*. A spring 144 is operatively received in the housing 104 such that one end of the spring 144 engages a first end 146 of a button 160 that is moved into and out of engagement with the ratchet wheel toothed outer circumferential surface 122*b* to prevent unwanted rotation of the ratchet wheel 122. The button 160 is operatively engaged with the spring 144 and allows a user to move one end of the button 146 into and out of engagement with the ratchet wheel toothed outer circumferential surface 122*b* against the bias of the spring 144. Referring to FIG. 5, the pin 160 is biased radially inward by the spring 144.

Clutch Mechanism

Referring again to FIGS. 3 and 6, the clutch 148 is received on the shaft 110 adjacent the shaft smooth portion 115, which is intermediate the threaded shaft second end 110*b* and the shaft splined portion 112. The clutch 148 is also received in, and rotationally fixed to, the second cover 108. That is, the second cover 108 contains a substantially square area that receives the substantially square clutch mechanism 148 so that the clutch mechanism is rotationally fixed to the second cover 108. It should be understood that the clutch mechanism 148 may be rotationally fixed to the second cover 108 by other suitable means. The clutch 148 has a smooth, circular inner circumferential surface 150 for receiving the shaft smooth portion 115. In various embodiments, the clutch 148 is generally square shaped and made from friction-modifying materials (e.g., Kevlar, metal, alloy, semi-metallic material, sintered metal, resin, carbon material, or woven glass material).

Adjustment Knob

The adjustment knob 152 is generally circular in shape and has a threaded inner circumferential surface that is configured to engage with the threaded portion 114 of the shaft second end 110*b*. The adjustment knob 152 is generally positioned on the shaft threaded portion 114 intermediate the second cover 108 and the knob bracket 130. A first spring 154 is positioned intermediate the adjustment knob 152 and the second cover 108 and a second spring is positioned intermediate the adjustment knob 152 and the adjustment knob bracket 130. The first and second springs 154 and 156 assist in biasing the shaft 110 in the axial direction depending on the position of the adjustment knob 152, which in turn causes the splined shaft 110 to either be rotationally fixed or rotatable with one of the ratchet wheel 122 or splined ring 116 depending on the shaft's position within the following parts: the splined ring 116, the spool body 120, the ratchet wheel 122, and the threaded knob 152.

Crank Shaft, Gear and Handle

Referring once again to FIG. 3, the handle 100 is coupled to a first end 102*a* of the crank 102 by a bolt 101. In various embodiments, the crank 102 may be integrally formed with the handle 100, or in other embodiments, the crank 102 may be connected to the handle 100 using any suitable fastener (e.g., a bolt, a pin, a rivet, weldments, etc.). The crank 102 and the handle 100 are generally perpendicular to each other when attached. The crank 102 also has a second end 102*b* with an opening 102*c* that is configured to operatively engage with a gear crank shaft 111. The gear crank shaft 111 is rotationally fixed to the crank 102 since the shape of the crank opening 102*c* matches the shape of an end 111*a* of the gear crank shaft 111. That is, the crank opening 102*c* and the end 111*a* of the gear crank shaft 111 are both substantially square in shape. In various embodiments, the crank 102 may be coupled to the gear crank shaft 111 in any suitable manner (e.g., a bolt, a pin, a rivet, a cotter pin, weldments, etc.).

The gear crank shaft 111 is operatively coupled to a crank gear 113 so that the gear crank shaft is rotationally fixed to the crank gear. In various embodiments, the crank gear 113 is integrally formed with the gear crank shaft 111. In various other embodiments, the crank gear 113 may be connected to the gear crank shaft 111 using any suitable fastener (e.g., a bolt, a pin, a rivet, a cotter pin, weldments, etc.). The crank gear 113 has teeth that match the teeth of the gear 142.

Parts Enclosed Inside the Housing Body

Referring to FIG. 4, when the bowstring cocking device is assembled, the following parts fit inside the housing body 104 beginning at the first cover 106 and progressing along to the second cover 108: the ratchet wheel 122, the gear 142, the rope spool body 120, the clutch mechanism 148, and running through the length of the inner circumference of each of these parts is the shaft 110. Thus, in the present embodiment, the bowstring cocking device 24 has at least a portion of the following parts exposed: the handle 100, the crank 102, the crank gear shaft 111 exposed through the opening 102*c* of the crank 102, the first cover 106, the first end of the splined shaft 110*a*, the housing body 104, the second cover 108, and the knob bracket 130 enclosing the knob 152, the first spring 154 (not shown), and the second spring 156.

Bowstring Cocking Device Operation

First Position

Figure 7:
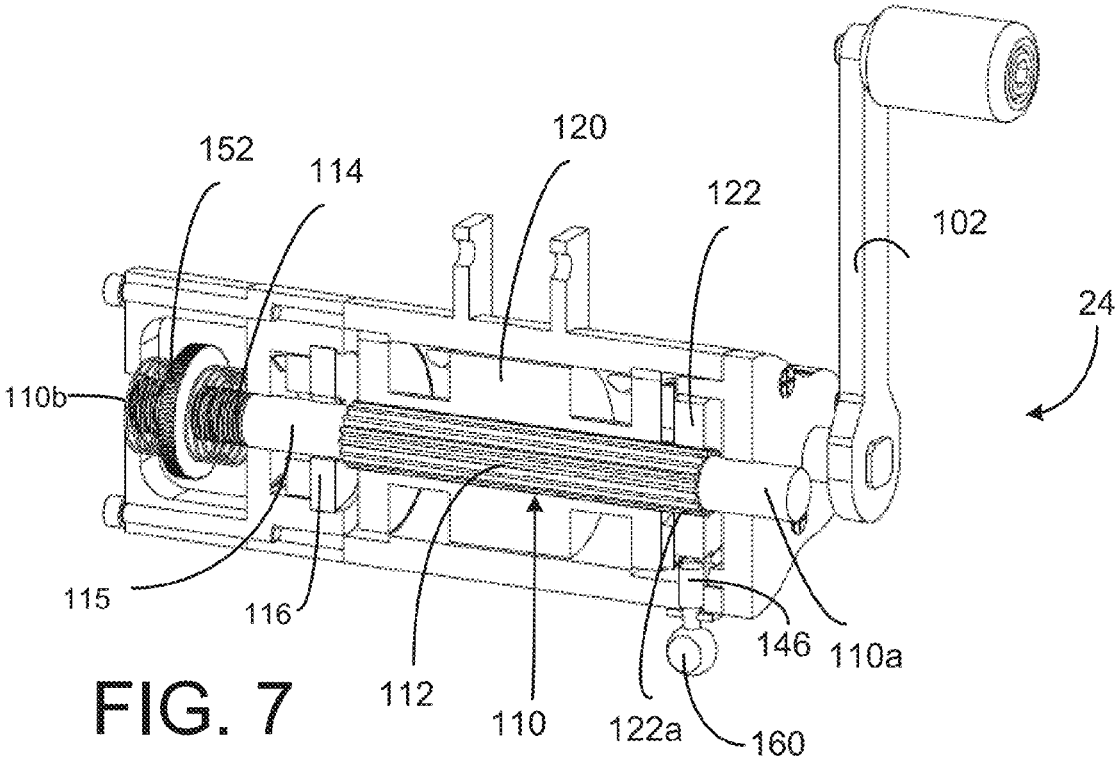
FIG. 7 is a partial perspective view of the bowstring cocking device of FIG. 3, in a first position.

Referring to FIG. 7, the bowstring cocking device 24 is shown in a first position where the shaft 110 is moved axially into a first position with respect to the housing body 104 such that the splined portion 112 is engaged with the ratchet wheel splined inner circumferential surface 122*a* o and is disengaged from the splined ring 116. In the first position, the splined ring 116 is positioned on the shaft smooth portion 115 so that the splined portion 112 is disengaged from the splined ring 116. The bowstring cocking device 24 may be moved into the first position as shown in FIG. 7 by turning the adjustment knob 152. Because the knob 152 has an inner circumferential surface that is threaded, the threaded engagement of the knob 152 with the threaded end 114 of the splined shaft 110 causes the shaft 110 to move axially (toward the right with regard to FIG. 7) so that the splined portion 112 engages with the inner circumferential splined surface of the ratchet wheel 122*a*, which causes the ratchet wheel 122 to be rotationally fixed with the shaft 110 while the splined ring 116 is allowed to rotate with respect to the shaft 110.

Referring again to FIG. 5, the teeth of the crank gear 113 engage with the teeth of the gear 142 so that rotation of the crank gear 113 in the clockwise direction causes the gear 142 to rotate in a counterclockwise direction (with respect to the view of FIG. 5). Thus when the crank 102 (FIG. 6) is turned clockwise, the gear crank shaft 111 also rotates clockwise in turn causing the crank gear 113 to rotate clockwise. This, in turn, rotates the gear 142 in the opposite, counter-clockwise, direction. Because the gear 142 is rotationally fixed to the shaft 110 via the spool body 120, and the ratchet wheel 122 and the spool body 120 are rotationally fixed to the shaft 110, rotation of crank 102 and crank shaft 111 clockwise causes the spool body 120 to rotate counterclockwise. As a result, as the rope spool body 120 rotates counterclockwise, it winds up the cocking rope 50 and pulls the bowstring 44 into the cocked position. Because the spring 144 biases the pin 146 into the ratchet wheel toothed outer circumferential surface 122*b*, the pin 146 prevents unwanted rotation of the ratchet wheel 122 in the clockwise direction. As a result, the spool body is also prevented from rotating in the clockwise direction since the ratchet wheel 122 and the spool body 120 is rotationally fixed to the shaft 110. In this way, the spool body 120 will not inadvertently rotate clockwise in response to the bias exerted on the bowstring cocking rope 50 by the bowstring 44.

Second Position

Figure 8:
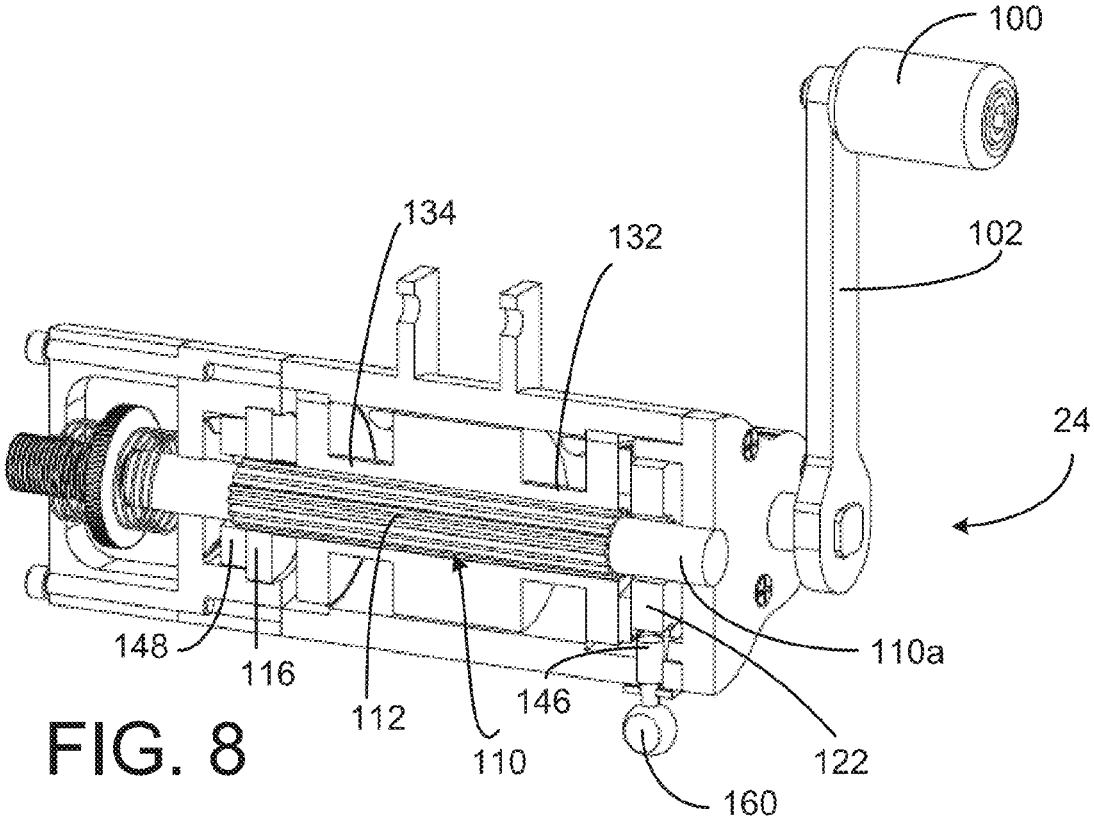
FIG. 8 is a partial perspective view of the bowstring cocking device of FIG. 3, in a second position.

FIG. 8 shows the shaft 110 in a second position where the shaft splined portion 112 is disengaged from the ratchet wheel 122 and is engaged with the splined ring 116. In the second position, either the bowstring cocking rope 50 may be slightly released so that the first and second hooks may be removed from the bowstring once the bowstring is in the cocked portion, or (2) the bowstring 44 may be moved from the firing position into the resting position without firing or dry firing the crossbow 10. The bowstring cocking device is moved into the second position when the user rotates the knob 152 so that the threaded engagement between the knob 152 and the threaded shaft portion 114 causes the shaft to move axially rearward (e.g., to the left in FIG. 8) so that the shaft splined portion 112 engages the splined ring 116 and disengages from the splined ratchet wheel 122.

Thus, when the bowstring cocking device 24 is in the second position, the ratchet wheel 122 no longer prevents the shaft 110 from rotating in the clockwise direction since the ratchet wheel 122 is no longer rotationally fixed to the shaft 110. Instead, the engagement of a face of the splined ring 116 with a face of the clutch mechanism 148 prevents the shaft 110 from spinning. That is, the frictional force between the face of the splined ring 116 and the corresponding face of the clutch mechanism 148 is greater than the pulling force exerted on the bowstring cocking rope 50 by the bowstring 44. As a result, the user may turn the handle 100 and the crank 102 in the counterclockwise direction in a controlled manner, which in turn causes the shaft 110 to rotate in the clockwise direction, thereby letting the rope 50 out from the rope spools 132, 134. In this way, the user can either release tension on the bowstring cocking rope to allow the user to remove the first and second hooks 50*a* and 50*b* from the bowstring 44 or to release the bowstring 44 from the cocked position into the resting position in a controlled manner without firing or dry firing the crossbow.

Bowstring Cocking Device Alternate Embodiment

Figure 9:
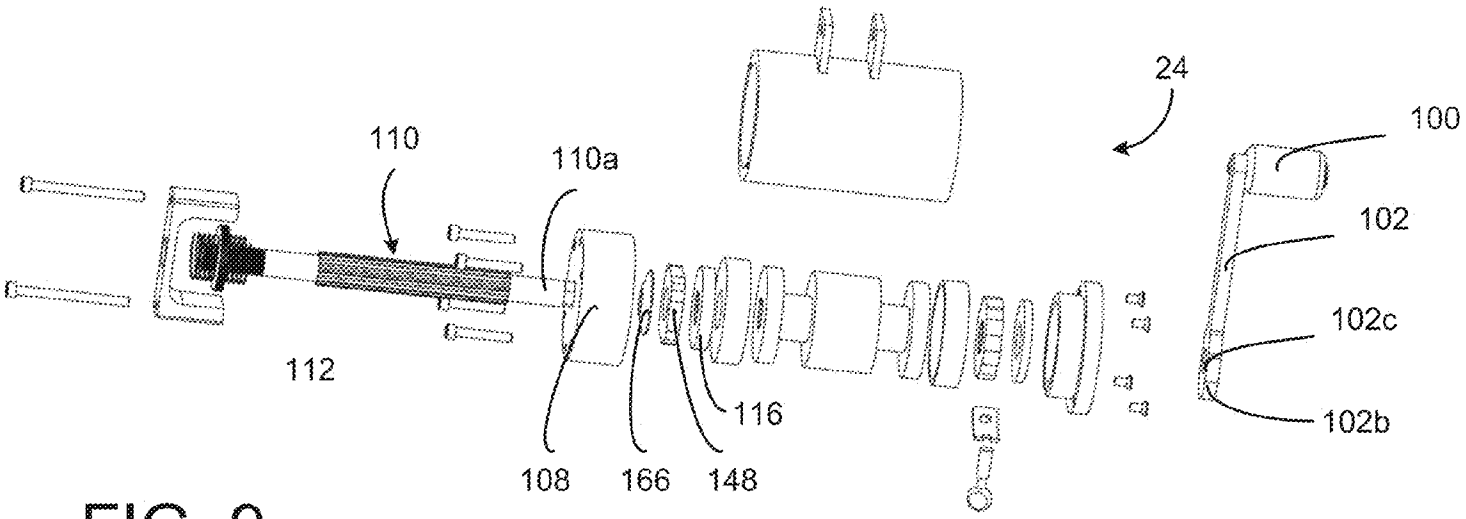
FIG. 9 is an exploded view of an embodiment of a bowstring cocking device for use in the crossbow of FIG. 1.
Figure 10:
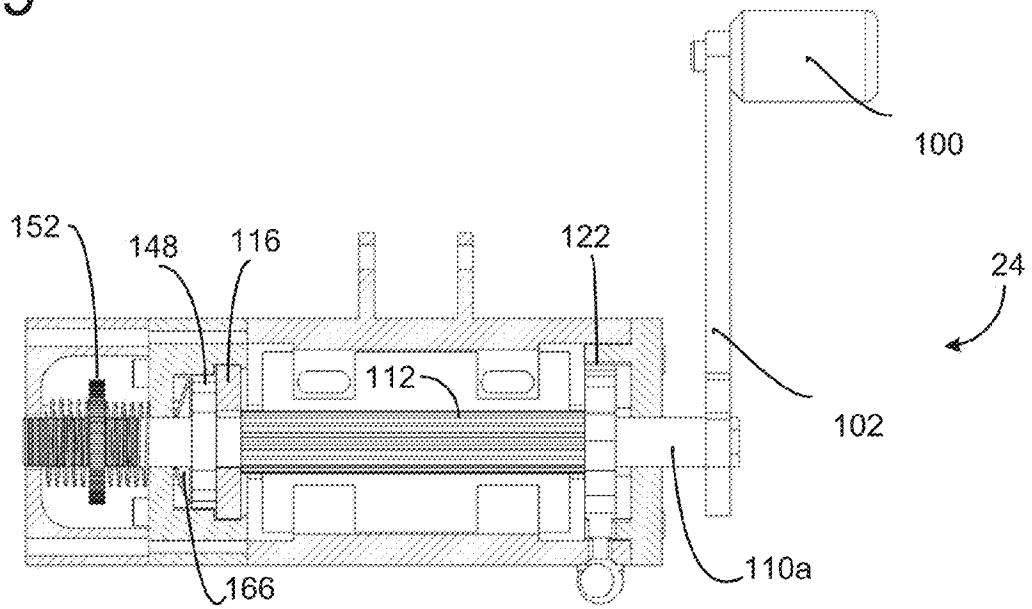
FIG. 10 is a partial sectional view of the bowstring cocking device of FIG. 9.

Referring to FIGS. 9 and 10, an alternative embodiment of the bowstring cocking device 24 is shown having a single shaft design as opposed to the dual shaft design shown in the embodiment of FIGS. 3-8. Thus, for purposes of ease of understanding and clarity, only certain parts will be discussed to highlight the differences in the structure and operation of the embodiment shown in FIGS. 9 and 10 as compared to the embodiment shown in FIGS. 3-8. The handle 100 and crank shaft 102 couples directly to the shaft 110. That is, the crank second end 102*b* contains a square opening 102*c* that mates with, and is rotationally fixed to, the first end 110*a* of the shaft 110. Additionally, this alternate embodiment utilizes a concave flat spring 166 that is positioned intermediate the second cover 108 and the clutch mechanism 148 to bias the clutch mechanism 148 into the splined ring 116. Similar to the embodiment shown in FIGS. 3-8, the shaft 110 is moveable between a first position in which the shaft splined portion 112 is engaged with the splines formed on the inner circumferential surface of the ratchet wheel 122 and disengaged from the splined ring 116, and the second position in which the shaft splined portion is engaged with the splined ring 116 and disengaged from the ratchet wheel 122 by rotating the adjustment knob 152 as described above.

Second Embodiment of Bowstring Cocking Device

Figure 11:
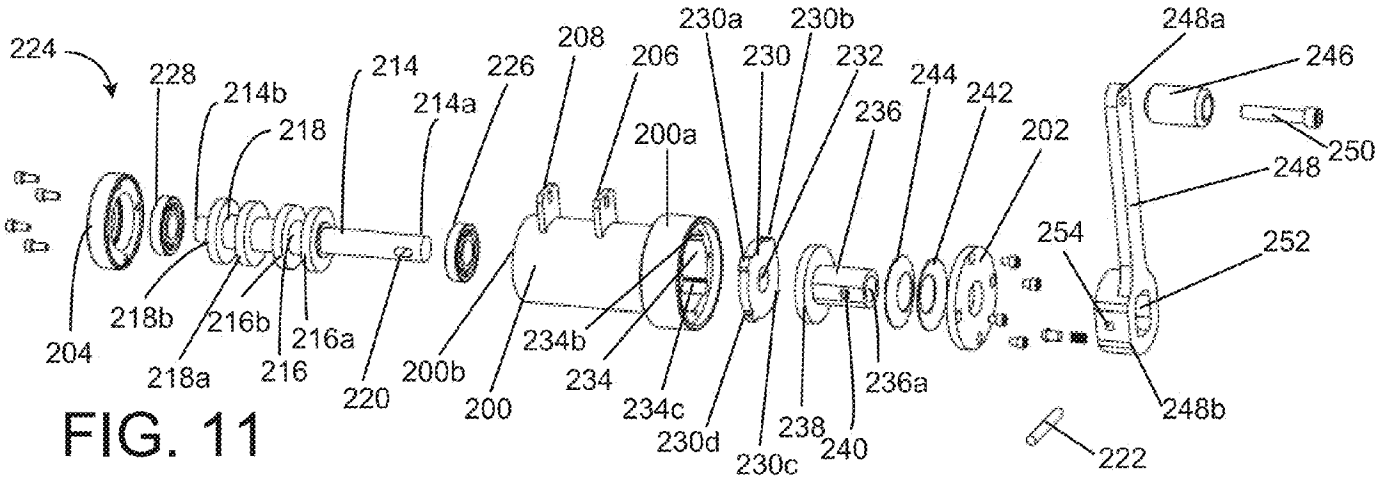
FIG. 11 is an exploded view of an embodiment of a bowstring cocking device for use in the crossbow of FIG. 1.
Figure 13:
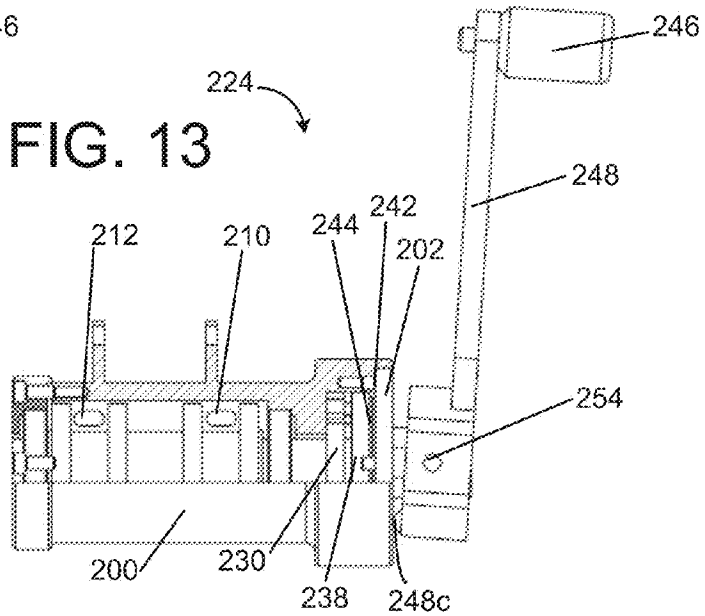
FIG. 13 is a partial sectional view of the bowstring cocking device of FIG. 11, in a second position.
Figure 12:
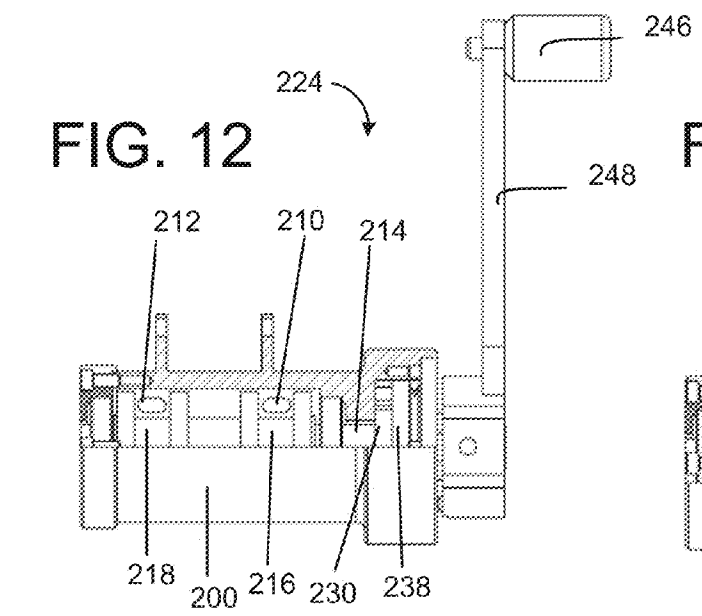
FIG. 12 is a partial sectional view of the bowstring cocking device of FIG. 11, in a first position.

FIGS. 11-13 illustrate a second embodiment of a bowstring cocking device 224 having a housing body 200, a single shaft 214, first and second rope spools 216 and 218, a clutch mechanism 230, a sleeve 236 and a crank 248.

Bowstring Cocking Device Structure

Housing Body

As shown in FIG. 11, the housing body 200 has a first end 200*a* and a second end 200*b*. Coupled to the first end of the housing body 200*a* is a first cover 202. Coupled to the second end of the housing body 200*b* is a second cover 204. The first cover 202 and the second cover 204 are rotationally fixed respectively to the housing body first end 200*a* and the housing body second end 200*b* by screws (not numbered) or other suitable fasteners such as bolts, rivets, weldments, etc. The first cover 202 and the second cover 204 enclose the various parts of the bowstring cocking device 224 within the housing body 200. The housing body 200 is generally cylindrical in shape, but may be formed in any suitable shape. In various embodiments, the housing body 200 may be formed from any suitable material (e.g., alloy, stainless steel, ceramic, polymers, etc.) and in particular embodiments the housing body is formed from aluminum. The housing body 200 also has a first mounting bracket 206 and a second mounting bracket 208 for attaching the bowstring cocking device 224 to the crossbow 10. Referring to FIGS. 12 and 13, the housing body 200 has a first opening 210 and a second opening 212 for allowing the bowstring cocking rope 50 to pass into the housing body 200.

Shaft, Rope Spools, and Bearings

As shown in FIG. 11, the bowstring cocking device 224 has a shaft 214 that has a first end 214*a* and a second end 214*b*. The shaft 214 is generally cylindrical in shape. The shaft 214 also has a first rope spool 216 and a second rope spool 218 received thereon proximate to the shaft second end 214*b*. The first spool 216 has a first end 216*a* and a second end 216*b*. In addition, the second spool 218 has a first end 218*a* and a second end 218*b*. Proximate to the first end of the shaft 214*a* is an elongated opening 220 for receiving a pin 222 as explained in more detail herein. The pin 222 is generally cylindrical in shape and may be formed from any suitable material such as aluminum, stainless steel, etc. The rope spools 216, 218 are received on, and rotationally fixed to, the shaft 214 intermediate the shaft first end 214*a* and the shaft second end 214*b*. The rope spools 216, 218 are configured to attach to a first and a second end of the bowstring cocking rope 50, which is configured to be releasably attached to the bowstring 44. In various embodiments, the spools 216, 218 are integrally formed with the shaft. In other embodiments, the first and second spools 216, 218 are attached to the shaft 214 using any suitable fastener (e.g., welded, screws, rivets, threaded attachment, etc.).

A first bearing 226 is received around the outer circumferential surface of the first spool first end 216*a*. Additionally, a second bearing 228 is received around the outer circumferential surface of the second spool second end 218*b*. The first and second bearings 226 and 228 allow the shaft to be mounted coaxially with a central axis (not shown) of the housing body 200 while allowing the shaft to rotate freely within the housing body.

Clutch Mechanism

A clutch mechanism 230 is positioned on the shaft 214 proximate to the first rope spool first end 216*a*. The clutch mechanism 230 is generally circular in shape and may be formed from friction-modifying materials (e.g., Kevlar, metal, alloy, semi-metallic material, sintered metal, resin, carbon material, or woven glass material). The clutch 230 has a circular inner circumference 232 for rotatably receiving the shaft 214 there through. The clutch 230 has a first tab 230*a*, a second tab 230*b*, a third tab 230*c*, and a fourth tab 230*d* that are used to rotationally fix the clutch mechanism 230 to the housing body 200. That is, a recess 234 is formed at the first end of the housing body 200*a* and is configured to receive the clutch mechanism 230. The clutch tabs 230*a*, 230*b*, 230*c*, 230*d* fit into a respective first tab slot 234*a* (not shown), second tab slot 234*b*, third tab slot 234*c*, and fourth tab slot 234*d* (not shown) formed around the perimeter of the recess 234. Thus, the clutch 230 is rotationally fixed to the housing body 200 by engagement of the tabs 230*a*, 230*b*, 230*c*, 230*d* and the tab slots 234*a* (not shown), 234*b*, 234*c*, 234*d* (not shown). In alternate embodiments, any number of tabs may be used to rotationally fix the clutch mechanism 230 to the housing body 200. In other embodiments, the clutch mechanism 230 may be rotationally fixed to the housing body 200 by other suitable affixing means such as screws, rivets, pins, etc.

Sleeve, Sleeve Disk, and Springs

A sleeve 236 is received about the shaft first end 214*a* intermediate to the clutch mechanism 230 and the first cover 202. The sleeve 236 is generally oblong shaped and has a disk 238 coupled at the end proximate to the clutch 230. The sleeve 236 has a substantially circular through hole 236*a* for receiving the shaft 214 and is rotationally fixed to the shaft 214 by a pin 222 that is received through an opening 240 in the sleeve 236. The disk 238 may be integrally formed with the sleeve 236 or it may be attached to the sleeve using any suitable connecting means such as screws, rivets, pins, press fit, weldments, etc. A first spring 242 and a second spring 244 are received about the sleeve 236 intermediate the disk 238 and the first cover 202 so that the first spring 242 abuts the first cover 202 and the second spring 244 abuts the disk 238. The first spring 242 is concave towards the first cover 202, while the second spring 244 is concave towards the sleeve disk 238. The springs 242 and 244 function to bias the sleeve 236 and disk 238 toward the clutch mechanism 230.

Crank Shaft, Gear and Handle

Still referring to FIG. 11, the bowstring cocking device 224 comprises a handle 246 and a crank 248. The handle 246 is coupled to a first end 248*a* of the crank 248 by a bolt 250. In various embodiments, the crank 248 may be integrally formed with the handle 246, or in other embodiments, the crank 248 may be connected to the handle 246 using any suitable fastener (e.g., a bolt, a pin, a rivet, weldments, etc.). The handle 246 and the crank 248 are generally perpendicular to each other when attached to one another. The crank 248 also has a second end 248*b* with an oblong first crank opening 252 that is configured to operatively engage with the oblong-shaped sleeve 236 to rotationally fix the sleeve 236 to the crank 248 since the shape of the first crank opening 252 matches the shape of the sleeve 236. That is, the first crank opening 252 and sleeve 236 are both substantially oblong in shape where the first crank opening 252 is slightly larger than the sleeve 236. In various embodiments, the crank 248 may be coupled to the sleeve 236 in any suitable manner (e.g., a bolt, a pin, a rivet, a cotter pin, weldments, etc.).

The crank also has a second opening 254 that is circular in shape, formed perpendicular to the first opening 252, and is configured for receiving the pin 222. When the pin 222 is inserted into the second opening 254, it passes through the crank 248, the circular opening 240 in the sleeve 236, and the elongated opening 220 in the shaft 214 to rotationally fix the shaft 214 and the sleeve 236 to the crank 248. Depending upon where the pin 222 is located in the elongated opening 220 of the shaft 214, the shaft 214 may be rotationally fixed or rotatable within the housing body 200 as described in more detail below.

Bowstring Cocking Device Operation

First Position

Referring to FIG. 12, the bowstring cocking device 224 is shown in a first position where the crank 248 is substantially perpendicular to the shaft 214. When the handle 246 is perpendicular to the housing body 200, the sleeve disk 238 is pushed against the clutch material 230 by the springs 242 and 244 so that friction between a surface of the clutch mechanism and a surface of the disk 238 prevents the shaft 214 from rotating either clockwise or counterclockwise. Thus, when the bowstring cocking device 224 is in this first position, the frictional force between the clutch mechanism 230 and the sleeve disk 238 is greater than the pulling force exerted by the bowstring 44 on the spools 216, 218 by the cocking rope 50. As a result, the shaft 214 will not spin in either direction due to the frictional force.

Second Position

In FIG. 13, the bowstring cocking device 224 is shown in a second position where the handle 246 is pulled away from the housing body 200, leaving the crank shaft 248 no longer perpendicular to the shaft 214. In particular embodiments, the user can grab the handle 246 and pull it outward, away from the housing body first end 200*a*, which causes the crank 248 to pivot about a pivot point 248*c* and angle away from the housing body 200. When the handle 246 and crank 248 are angled as shown in FIG. 13, the sleeve 236 and the disk 238 are moved axially toward the first cover 202 against the bias of springs 242 and 244 so that the disk 238 partially disengages from the clutch mechanism 230. Because of the oblong opening 240 (FIG. 11) in the shaft 240, the pin 222 can slide within the oblong opening 240 allowing the sleeve 230 and the sleeve disk 238 to slide slightly along the length of the shaft 214 relative to the clutch mechanism 230. The sliding action of the sleeve 236 and sleeve disk 238 releases the frictional force between the clutch mechanism 230 and the sleeve disk 238 allowing the sleeve 230, sleeve disk 238 and shaft 214 to rotate with respect to the housing body 200. Thus, the user can rotate the handle in either the counterclockwise or clockwise direction from the perspective of looking toward the handle from the right in FIG. 13. As a result, the user may turn the handle in the counterclockwise direction to move the bowstring 44 from the resting position into the cocked position. Moreover, once the bowstring is in the cocked position and is retained by the trigger mechanism, the user can release the tension on the bowstring 44 by the bowstring cocking rope 50 a sufficient amount to allow the user to remove the first and second hooks 50*a* and 50*b* from the bowstring 44. Furthermore, should the user want to move the bowstring 44 from the cocked position to an un-cocked position without firing or dry firing the crossbow, the user may do so by moving the bowstring cocking device 224 into the second position and turning the handle 246 and crank 248 clockwise.

Second Bowstring Cocking Device Alternate Embodiment

Figure 14:
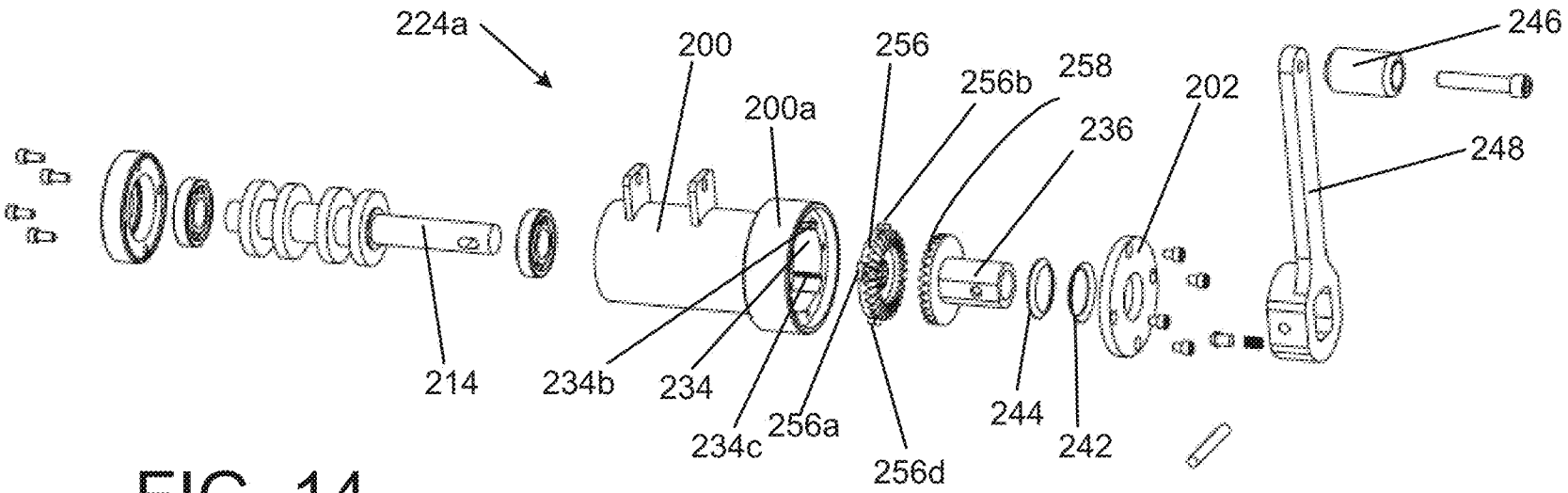
FIG. 14 is an exploded view of an embodiment of a bowstring cocking device for use in the crossbow of FIG. 1.

FIG. 14 illustrates an alternative embodiment of the bowstring cocking device 224 of FIGS. 11-13. For purposes of ease of understanding and clarity, only certain parts will be discussed to highlight the differences in the structure and operation of the embodiment shown in FIG. 14 as compared to the embodiment shown in FIGS. 11-13. In this embodiment, the clutch mechanism 230 shown in FIGS. 11-13 is replaced with a toothed ratchet wheel 256 that is received in the housing body 200 proximate to the housing body first end 200*a*. The ratchet wheel 256 is also received on the shaft first end 214*a* intermediate the first housing spool first end 216*a* and the shaft first end 214*a*. Similar to the clutch mechanism 230 in FIG. 11, the toothed ratchet wheel 256 in FIG. 14 has a first tab 256*a*, a second tab 256*b*, a third tab 256*c* (not shown), and a fourth tab 256*d*. The tabs 256*a*, 256*b*, 256*c* (not shown), 256*d* fit into respective tab slots 234*a* (not shown), 234*b*, 234*c*, 234*d* (not shown) of the recess 234 formed in the housing body first end 200*a* to rotationally fix the ratchet wheel 256 to the housing body 200. The toothed ratchet wheel 256 has radial teeth formed on one face of the fixed wheel 256 facing the first cover 202.

The sleeve 236 in this embodiment is positioned intermediate to the first cover 202 and the toothed ratchet wheel 256. The sleeve 236 is coupled to a toothed sleeve disk 258 having radial teeth on the surface of the disk 258 facing the toothed ratchet wheel 256. The teeth of the toothed ratchet wheel 256 oppose the teeth of the toothed sleeve disk 258 and rotationally fix the disk 258 to the toothed ratchet wheel 256. The shape of the teeth of the disk 258 (e.g., angle of the tooth surfaces) and the force exerted by the springs 242, 244 determine the frictional force between the toothed sleeve disk 258 and the toothed ratchet wheel 256. That is, the frictional force must be greater than the tension force pulled on the bowstring cocking rope 50 by the bowstring 44. The operation of the bowstring cocking device 224*a* of FIG. 14 is similar to that of FIGS. 11-13 in that in order to rotate the handle 246 an crank 248, the user must pull the handle and crank away from the first cover 202 so that the sleeve 236 and disk 258 a pulled slightly away from the ratchet wheel 256. In this way, the shaft 214 may be rotated with respect to the housing body 200.

Third Embodiment of Bowstring Cocking Device

Figure 15:
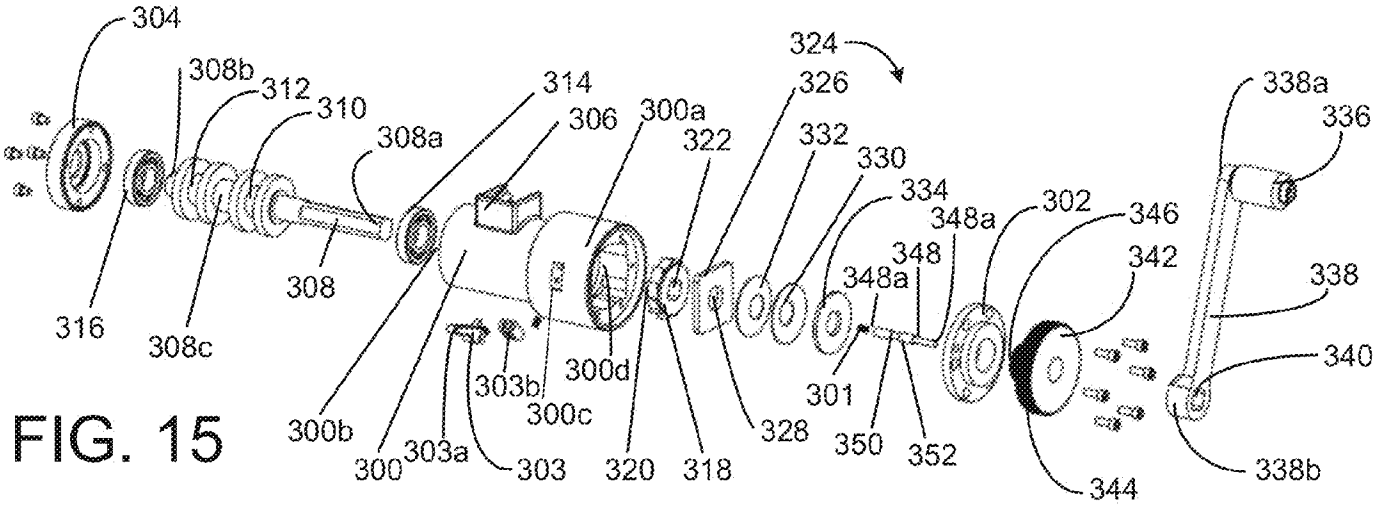
FIG. 15 is an exploded view of an embodiment of a bowstring cocking device for use in the crossbow of FIG. 1.
Figure 16:
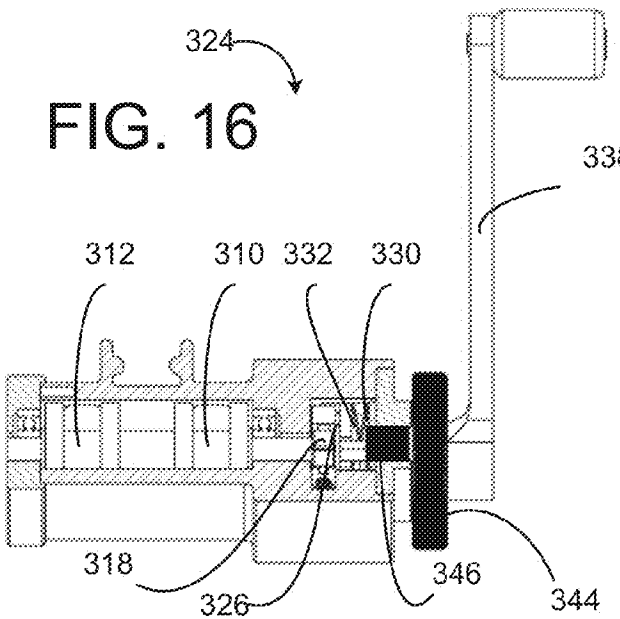
FIG. 16 is partial sectional view of the bowstring cocking device of FIG. 15.
Figure 17:
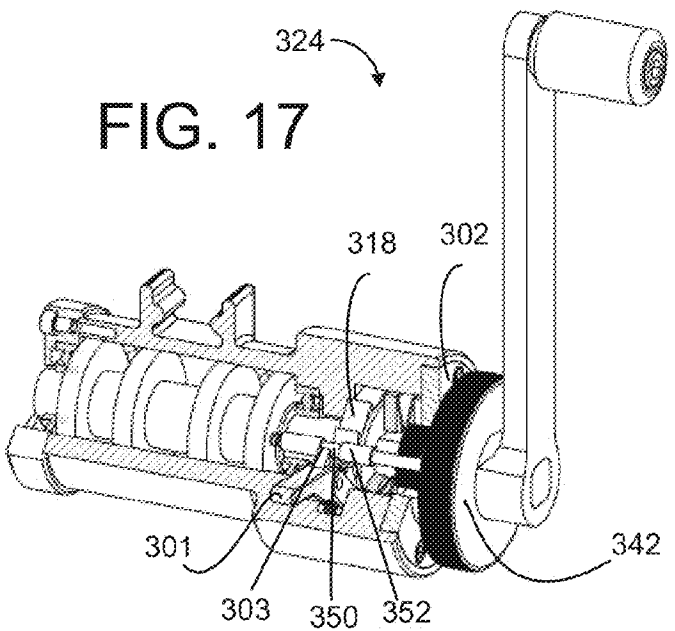
FIG. 17 is partial perspective view of the bowstring cocking device of FIG. 15.

FIGS. 15-17 illustrate a third embodiment of a bowstring cocking device 324 having a single shaft 308 and a clutch mechanism 326.

Bowstring Cocking Device Structure

Housing Body

Referring to FIG. 15, the bowstring cocking device 324 has a housing body 300 that is generally cylindrical in shape and may be formed from any suitable material (e.g., alloy, stainless steel, ceramic, polymers, etc.). The housing body 300 has a first end 300*a* that is configured to receive a first cover 302 and a second end 300*b* that is configured to receive a second cover 304 that are coupled to the housing body using fasteners (e.g., rivets, screws, bolts, etc.) (not numbered). The outer circumference of the first end 300*a* is generally greater than the outer circumference of the second end 300*b*. Proximate to the second end of the housing body 300 is a mounting bracket 306 that is configured to attach the bowstring cocking device 324 to the crossbow 10. The housing body also has a first opening 300*c* proximate the housing body first end 300*a*. The housing body first opening 300*c* is generally square shaped and configured to receive a detent 301 having a lever 303 formed at one end.

Shaft, Rope Spools, and Bearings

Running the axial length of the housing body 300 from the first cover 302 to the second cover 304 is a shaft 308 that is rotationally mounted in the housing via a first bearing 314 and a second bearing 316. The shaft has a first end 308*a* proximate to the first cover 302, a second end 308*b* proximate to the second cover 304, and a middle portion 308*c* intermediate to the first and second ends 308*a* and 308*b*. The shaft first end 308*a* is generally square shaped in cross section. The shaft second end 308*b* and the middle portion 308*c* are generally circular in cross section. A first spool 310 and a second spool 312 are coupled to the shaft 308 intermediate the shaft first and second ends 308*a* and 308*b*. The spools 310, 312 are configured to attach to a first and a second end of the cocking rope 50, respectively, which is configured to be releasably attached to the bowstring 44 by the first and second hooks 50*a* and 50*b*. In various embodiments, the spools 310, 312 are integrally formed with the shaft 308, and in other embodiments, the spools 310, 312 are coupled to the shaft 308 via suitable fasteners (e.g., screws, pins, weldments, press fit, etc.).

Ratchet Wheel

Positioned intermediate the first spool 310 and the shaft first end 308*a* is a ratchet wheel 318. The ratchet wheel is received on and rotationally fixed to the shaft 308. The ratchet wheel 318 has a toothed outer circumferential surface 320 and a generally square shaped inner circumference 322. The ratchet wheel 318 is rotationally fixed to the shaft 308 by the interaction of the generally square shaped inner circumference 322 and the square shaped shaft first end 308*a*.

Clutch Mechanism

The clutch mechanism 326 is received in a generally square shaped recess 300*d* formed in the housing body first end 300*a* and is received on the shaft 308 intermediate he ratchet wheel 322 and the first cover 302. The clutch 326 is generally square shaped and may be made from any friction-modifying material (e.g., Kevlar, metal, alloy, semi-metallic material, sintered metal, resin, carbon material, or woven glass material). The shaft 308 is rotatably received through a circular center hole 328 formed in the clutch mechanism 326. The clutch mechanism 326 is rotationally fixed to the housing body 300 since the shape of the clutch mechanism 326 matches the shape of the recess 300*d*.

Springs and Washer

A first spring 330 and a second spring 332 are received on the shaft 308 intermediate the clutch mechanism 326 and the first cover 302. A washer 334 is received on the shaft 308 intermediate the first spring 330 and the first cover 302. The first spring 330 is concave towards the washer 334, while the second spring 332 is concave towards the clutch mechanism 326.

Handle and Crank Shaft

As shown in FIG. 15, the bowstring cocking device 324 comprises a handle 336 and a crank 338. The handle 336 is rotatably coupled to a first end 338*a* of the crank 338 using any suitable fastener (e.g., a bolt, a pin, a rivet, weldments, etc.). In various embodiments, the crank 338 may be integrally formed with the handle 336. The handle 336 and the crank 338 are generally perpendicular to each other when attached to one another. The crank 338 also has a second end 338*b* having a generally square shaped opening 340 that is configured to operatively engage with the shaft squared first end 308*a*. The shaft 308 is rotationally fixed to the crank 338 by the interaction of the shaft square first end 308*a* and the crank square shaped opening 340. In various embodiments, the crank 338 may be coupled to the shaft 308 in any suitable manner (e.g., a bolt, a pin, a rivet, a cotter pin, weldments, press fit, etc.).

Safety Mechanism

A screw wheel 342, safety 348 and a detent 303 together form a safety mechanism that allows and prevents the detent 303 from engaging the ratchet wheel teeth 320. The screw wheel 342 has a first portion 344 and a threaded second portion 346. The threaded second portion 346 is threadedly received in a threaded opening 302*b* formed in the first cover 302. Thus, the screw wheel 342 is both rotatable and axially moveable with respect to the first cover 302. The wheel first portion 344 is positioned intermediate to the crank 338 and the first cover 302 and is, therefore, not received within the housing body 300.

The safety 348 is positioned substantially parallel to the axis of the shaft 308 and has a first end 348*a* that abuts a surface of the wheel first portion 344. As shown in FIGS. 15 and 17, the safety 348 has a first end 348*a*, a recessed middle portion 350, and a raised portion 352. The safety 348 is positioned intermediate to the housing body 300 and the screw wheel 342. A spring 301 is positioned intermediate the housing body 300 and a second end 348*b* of the safety 348 and is configured to bias the safety 348 toward the screw wheel first portion 344. Thus, when the wheel 342 is rotated so that it moves axially with respect to the first cover 302 toward the housing body first cover 302, the safety 348 is biased axially toward the housing second cover 304 thereby aligning the recessed portion 350 with the detent lever second end 303*b*. If, on the other hand, the screw wheel 342 is rotated in the opposite direction so that the screw wheel second portion moves axially away from the housing body first cover 302, the spring 301 biases the safety 348 toward the first cover 302.

Bowstring Cocking Device Operation

Referring to FIGS. 15, 16 and 17, the safety 348 is moveable between a first position in which the safety raised portion 352 aligns with the detent lever 303 thereby preventing the detent lever second end 303*b* from engaging the ratchet wheel teeth 320 and a second position in which the safety recessed portion 350 aligns with the detent lever 303 thereby allowing the detent lever second end 303*b* to engage with the ratchet wheel teeth 320. When the screw wheel 342 is rotated so that the screw wheel first portion 342 moves away from the radial face of the first cover 302, the safety 348 is in the second position so that the safety recessed area 350 aligns with the lever 303. In this position, engagement of the detent lever second end 303*b* with the ratchet wheel teeth 320 allows the handle 336 and crank 338 to rotate in the counterclockwise direction but prevents rotation of the handle 336 and crank 338 in the clockwise direction. Thus, the user can rotate the handle and crank counterclockwise so that the bowstring cocking rope 50 is wound onto the first and second rope spools 310 and 312 thereby pulling the bowstring 44 into the cocked position.

Once the bowstring 44 is in the cocked position where the trigger device on the crossbow 10 retains the bowstring 44 in the cocked position, the user may rotate the wheel 342 to move the screw wheel first portion 344 axially toward the first cover 302 while pressing on the detent first end 303*a* so that the safety raised portion 352 aligns with the detent lever 303 thereby preventing the detent lever second end 303*b* from engaging with the ratchet wheel teeth 320. Additionally, as the screw wheel first portion 344 moves axially toward the first cover 302, the screw wheel second portion 346 abuts and biases the washer 334 axially toward the first and second springs 330 and 332 thereby compressing the springs. As the first and second springs 330 and 332 compress, they exert pressure on the clutch mechanism 326 thereby increasing the frictional forces between the clutch mechanism 326 and the ratchet wheel 318.

Thus, in the first position, friction between the clutch mechanism 326 and the ratchet wheel face 318 prevents the shaft 308 from rotating in either the clockwise or counterclockwise direction. That is, the frictional force between the clutch mechanism 326 and the ratchet wheel front face 318 is larger than the pulling force exerted by the bowstring 44 on the bowstring cocking rope 50. As a result, the clutch mechanism 326 prevents the shaft 308 from rotating in a first direction and an opposite direction until a force is exerted on the handle 336 in combination with the pulling force on the bowstring cocking rope 50 is large enough to overcome the frictional force. Thus, once the bowstring 44 is cocked, the user may turn the handle 336 and crank 338 in the clockwise direction to allow the bowstring 44 to rest against the crossbow trigger mechanism (not shown) in the cocked position. Moreover, further rotation in the clockwise direction allows the user to insert slack in the bowstring cocking rope 50 thereby allowing the user to remove the first and second hooks 50*a* and 50*b* from the bowstring 44. Finally, if the user wishes to move the bowstring 44 from a cocked position into the resting position, the user can also continue to rotate the handle 336 and crank 338 in the clockwise direction to move the bowstring into the resting position without having to fire or dry fire the crossbow.

Bowstring Cocking Device Alternate Embodiment

Figure 18:
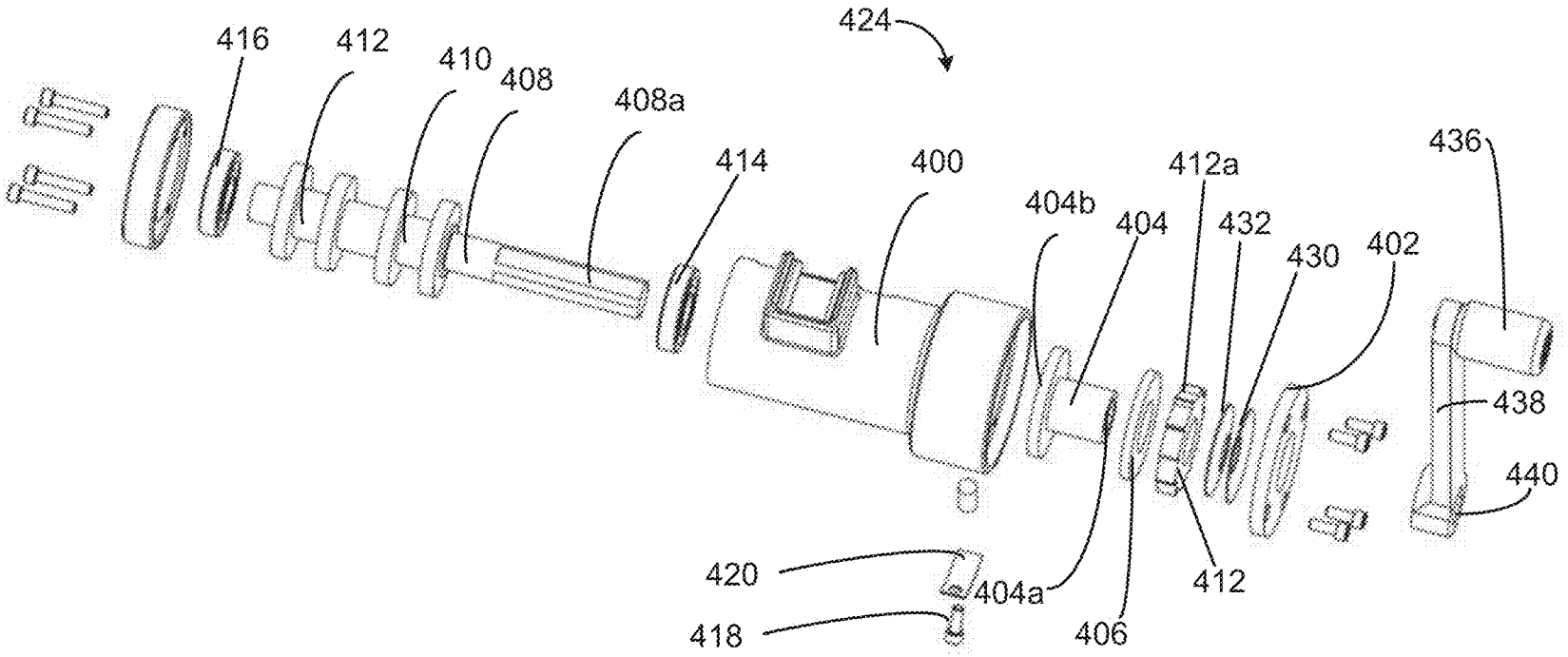
FIG. 18 is an exploded view of an embodiment of a bowstring cocking device for use in the crossbow of FIG. 1.
Figure 19:
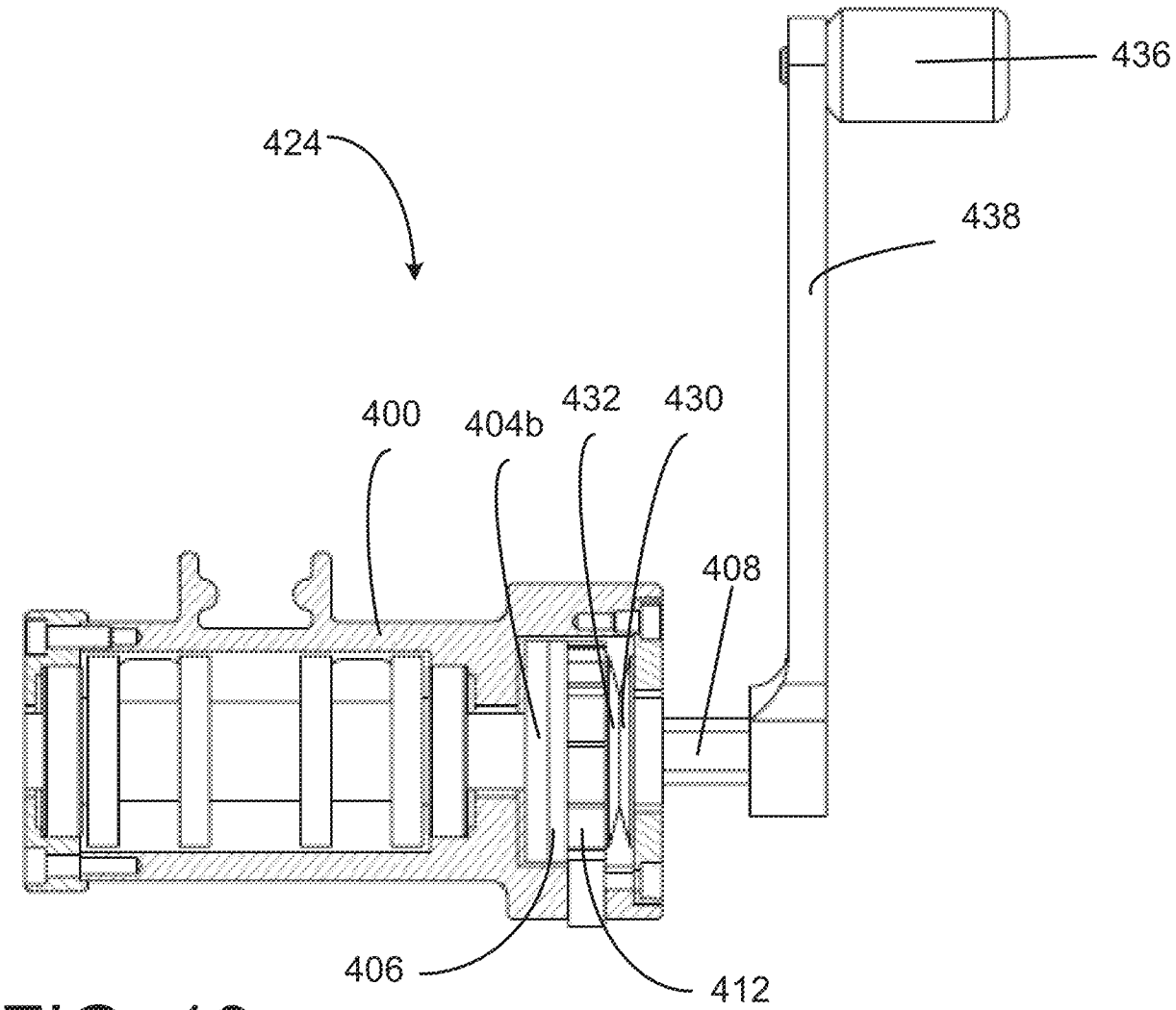
FIG. 19 is partial sectional view of the bowstring cocking device of FIG. 18.

FIGS. 18 and 19 illustrate an embodiment of a bowstring cocking device 424 that is similar to the bowstring cocking device 324 of FIGS. 15-17. For purposes of ease of understanding and clarity, only certain parts will be discussed to highlight the differences in the structure and operation of the embodiment shown in FIGS. 18-19 as compared to the embodiment shown in FIGS. 15-17. The bowstring cocking device 424 contains a housing body 400, a shaft 408 having a first square shaped end 408*a* and a second end 408*b* having a first and second rope spool 410 and 412 formed thereon. Similar to the bowstring cocking device 324, first and second bearings 414 and 416 are received on the shaft 408 to allow the shaft to rotate with respect to the housing body 400. A sleeve 400 is rotationally fixed to the shaft first end 308*a*. A disk 406, a ratchet wheel 412, and first and second springs 430 and 432 are received on, and rotatable with respect to the sleeve 400. A crank 438 is rotationally fixed to the shaft first end 408*a* and has a handle 436 rotatably coupled thereto by a suitable fastener.

Sleeve

As shown in FIG. 18, the sleeve 404 is rotationally fixed to the shaft 408 since the sleeve 404 contains a square opening 404*a* that is configured to receive the square shaft first end 408*a* therein. At the end of the sleeve 404 proximate to the first rope spool 410 is a sleeve disk 404*b* that is rotationally fixed to the sleeve 404. In various embodiments, the sleeve disk 404*b* is integrally formed with the sleeve 404. In still other embodiments, the sleeve disk 404*b* may be formed separately from the sleeve 404 and fastened to the sleeve using any suitable fastener such as pins, rivets, screws, weldments, etc.

Clutch, Springs, and Ratchet Wheel

Encircling the sleeve 404 is the clutch mechanism 406, the ratchet wheel 412, and the first spring 430 and the second spring 432. The clutch mechanism 406 is positioned intermediate the sleeve disk 404*b* and the ratchet wheel 412. The second spring 432 is positioned intermediate the ratchet wheel 412 and the first spring 430. And the first spring 430 is positioned intermediate the second spring 432 and a first cover 402. The clutch mechanism 406 is generally circular in shape and made from friction-modifying materials (e.g., Kevlar, metal, alloy, semi-metallic material, sintered metal, resin, carbon material, or woven glass material). The first spring 430 is concave towards the first cover 402, while the second spring 432 is concave towards the ratchet wheel 412.

Detent

A pin 418 is received through the housing body 400 and engages with a spring 420 at the bottom of the housing body 400. The spring 420 biases the pin 418 radially inward toward the ratchet wheel 412 so that the pin 418 engages the ratchet wheel teeth 412*a* formed on an outer circumferential surface of the ratchet wheel 412 thereby preventing rotation of the ratchet wheel in the counterclockwise direction while allowing the ratchet wheel to rotate in the clockwise direction. When the pin 418 is pulled out against the bias of the spring 420, the pin 418 no longer engages with the ratchet wheel teeth 412*a* thereby allowing the ratchet wheel to rotate in both the clockwise and counterclockwise direction.

Bowstring Cocking Device Operation

Referring to FIG. 19, the bowstring cocking device 424 is used to pull the bowstring 44 of the crossbow 10 into a cocked position by turning the shaft 408 in the clockwise direction using the handle 436 and crank 438. As the shaft 408 rotates, the ratchet wheel 412 also rotates in the clockwise direction since it is rotationally fixed to the shaft 408 via the clutch mechanism 406 and the sleeve disk 404*b*. As a result, as the ratchet wheel rotates in the clockwise direction, the pin 418 pops over the ratchet wheel teeth 412*a*. Once the bowstring is moved into the cocked position, the user may rotate the shaft 408 in the counterclockwise direction be applying rotational force to the shaft 408 via the crank 438 and handle 436. That is, the rotational force applied by the user is sufficient to overcome the frictional force between the ratchet wheel 412, the sleeve disk 404*b* and the clutch mechanism 406. Thus, the user can place slack in the bowstring cocking rope to allow the first and second hooks 50*a* and 50*b* to be removed from the bowstring 44. Once the first and second hooks are removed from the bowstring 44, the user may rotate the shaft 408 in the clockwise direction once again to take up any remaining bowstring cocking rope 50 so that the first and second hooks are positioned adjacent the housing body 400. Once the crossbow is fired, the user may pull the pin 418 out of engagement with the ratchet wheel teeth 412*a* so that the first and second hooks 50*a* and 50*b* may be easily pulled from the housing body 400 and hooked onto the bowstring 44.

If the user wishes to move the bowstring 44 from a cocked position into an un-cocked position, the user may simply apply rotational force to the shaft 408 in the counterclockwise direction so that bowstring cocking rope 50 is wound off the first and second rope spools 410 and 412. Rotation of the shaft 408 in the counterclockwise direction is controlled by the frictional forces that are exerted between the clutch mechanism 406 and the sleeve disk 404*b* and the frictional forces that are exerted between the clutch mechanism 406 and the ratchet wheel 412. Thus, if the user releases the handle 436, the shaft will not spin out of control due to the pulling forces exerted on the shaft 408 by the bowstring 44.

Fourth Embodiment of Bowstring Cocking Device

FIGS. 20-24 illustrate a fourth embodiment of a bowstring cocking device 524 that is similar to the bowstring cocking device 24 of FIGS. 3-8. For purpose of ease of understanding and clarity, only certain parts will be discussed to highlight the differences in the structure and operation of the embodiment shown in FIGS. 20-24, as compared to the embodiment shown in FIGS. 3-8.

Bowstring Cocking Device Structure

Figure 20:
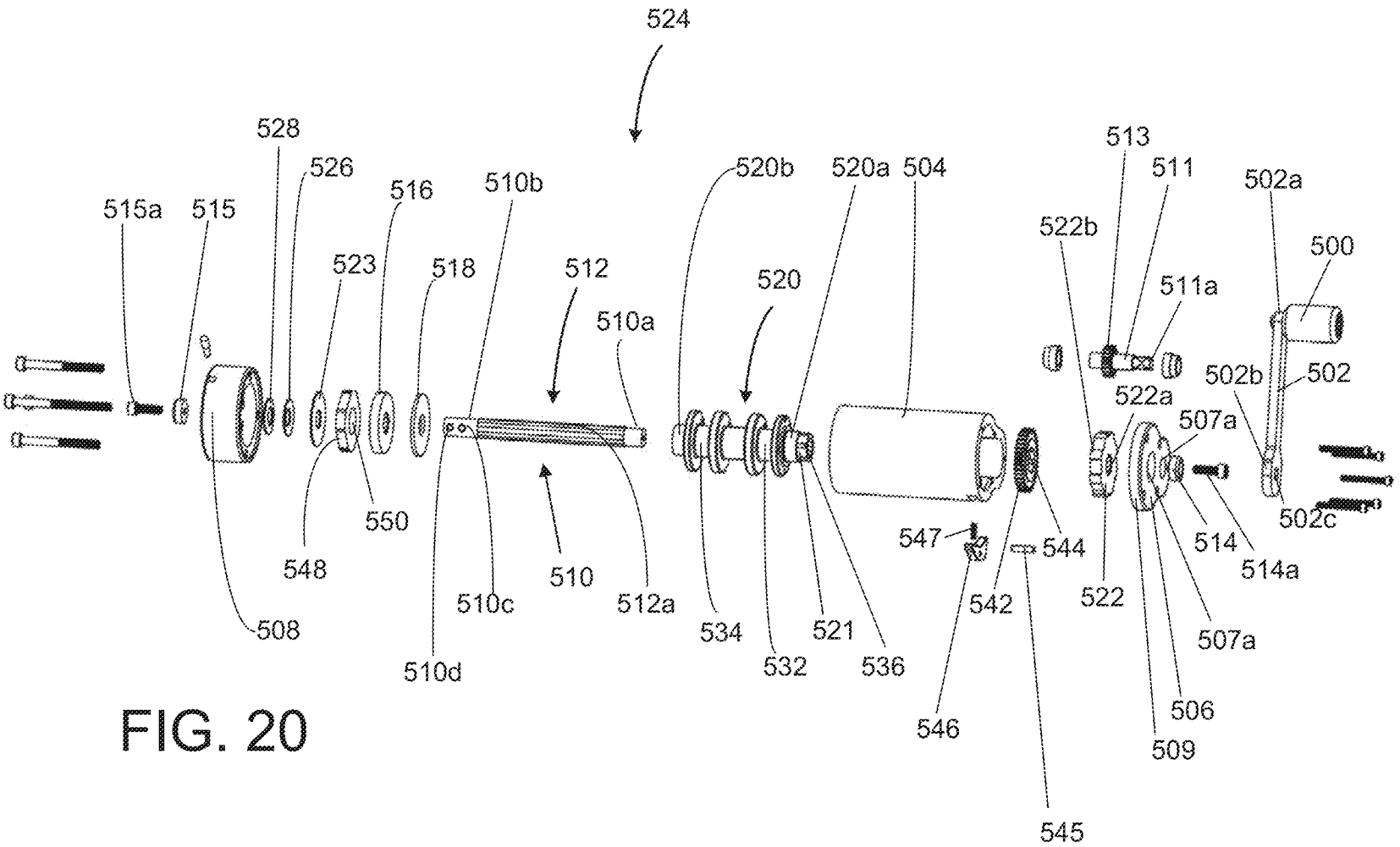
FIG. 20 is an exploded view of an embodiment of a bowstring cocking device for use in the crossbow of FIG. 1.

Referring to FIG. 20, one embodiment of a bowstring cocking device 524 is shown. In particular, the bowstring cocking device 524 comprises a handle 500, a crank 502, a housing body 504 having a first cover 506 and second cover 508, a shaft 510, a spool body 520, a ratchet wheel 522, a gear 542, and a clutch mechanism 548.

Housing Body

The first cover 506 and the second cover 508 together enclose the various parts of the bowstring cocking device 524 within the housing body 504. The housing body 504 is generally cylindrical in shape, but may be formed in any suitable shape. In various embodiments, the housing 504 may be formed from any suitable material (e.g., alloy, stainless steel, ceramic, polymers, etc.), and in particular embodiments, the housing 504 is formed from aluminum. The first cover 506 has a first opening 507*a* and a second opening 507*b* (as shown in FIGS. 21-24). The inner circumference of the second opening 507*b* is smaller than the inner circumference of the first opening 507*a*.

Shaft

The shaft 510 has a first end 510*a*, a second end 510*b* and a splined portion 512 intermediate the first and second ends 510*a* and 510*b*. The shaft first and second ends 510*a*, 510*b* have a generally smooth outer circumference. The shaft second end 510*b* also has a first and second opening 510*c*, 510*d*. The splined shaft 510 is generally cylindrically shaped with axial splines 512*a* formed on an outer circumference of the shaft intermediate to the first end 510*a* and the second end 510*b* where each axial spline is substantially parallel to the axis of the shaft 510.

The shaft 510 is rotatably mounted in the housing 504 so that the shaft first end 510*a* extends through the first cover second opening 507*b* and is coupled to a first cap 514 by a first cap screw 514*a*. In various embodiments, the shaft first end 510*a* may be integrally formed with the first cap 514, or in other embodiments, the shaft first end 510*a* may be connected to the first cap 514 using any suitable fastener (e.g., a bolt, a pin, a rivet, weldments, etc.). In addition, the shaft second end 510*b* extends through the second cover 508 and is coupled to a second cap 515 by a second cap screw 515*a*. In various embodiments, the shaft second end 510*b* may be integrally formed with the second cap 515, or in other embodiments, the shaft second end 510*b* may be connected to the second cap using any suitable fastener (e.g., a bolt, a pin, a rivet, weldments, etc.).

The shaft splines 512*a* are configured to interact with a splined ring 516, a splined inner circumferential bore 536 of the rope spool body 520, and a splined inner circumferential surface 522*a* of the ratchet wheel 522. The second end 510*b* of the shaft 510 is configured to receive a disk 518, the splined ring 516, the clutch mechanism 548, a washer 523, the first spring 526, and the second spring 528.

Rope Spool Body

Figure 21:
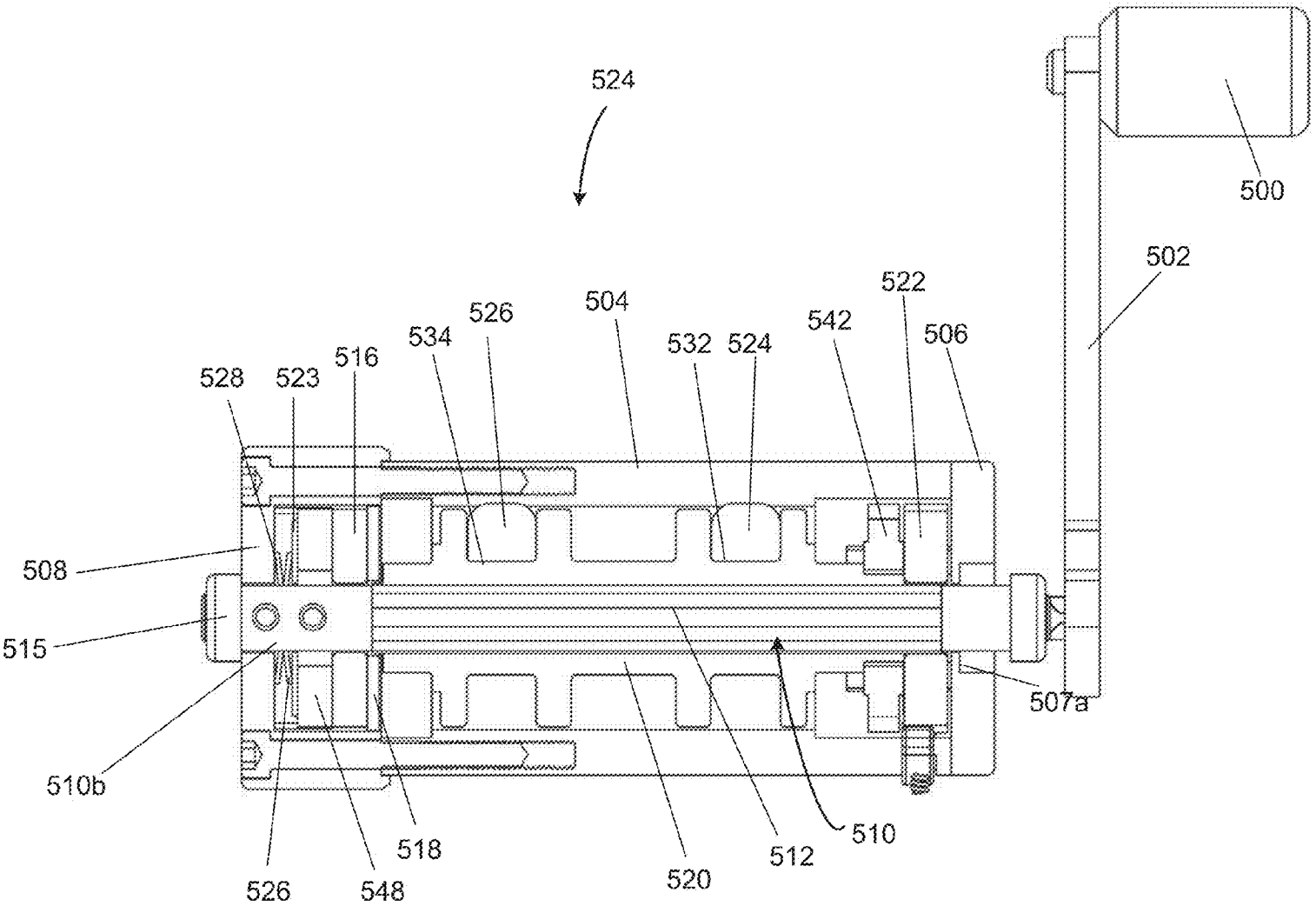
FIG. 21 is a partial sectional view of the bowstring cocking device of FIG. 20, in a first position.

The rope spool body 520 comprises a first end 520*a* and a second end 520*b*. The rope spool body 520 is generally cylindrical in shape and has a first rope spool 532 and a second rope spool 534. The rope spools 532, 534 provide a space for the bowstring cocking rope 50 to wind around when the bowstring 44 is pulled from the resting position into the cocked position. The rope spool body 520 is received on, axially moveable with respect to, and rotationally fixed to the shaft 510 by the splined bore 536. The outer circumference of the rope spool body first end 520*a* is generally circular with a hexagonally shaped end 521. In addition, the rope spools 532 and 534 are configured to operatively attach to a first and a second end of the bowstring cocking rope 50. Referring to FIG. 21, a first opening 524 and a second opening 526 in the housing body 504 are positioned above the first rope spool 532 and the second rope spool 534, respectively, and allow the cocking rope 50 (not shown) to enter the housing body 504 and wind around the rope spools 532, 534.

Gear

Referring again to FIG. 20, the gear 542 has a generally hexagonal inner circumference 544 that is configured to operatively engage with the rope spool body hexagonally shaped end 521 to rotationally fix the rope spool body 520 to the gear 542 That is, the gear inner circumference 544 and rope spool body hexagonally shaped end 521 are both substantially hexagonal in shape where the gear inner circumference 544 is slightly larger than the rope spool body hexagonally shaped end 521. In various embodiments, the gear 542 may be integrally formed with the rope spool body 520. In still other embodiments, the gear 542 may be rotationally fixed to the shaft 510 via a splined engagement similar to the splined engagement between the rope spool body 520 and the shaft splines 512*a*.

Ratchet Wheel and Detent

The ratchet wheel 522 is positioned intermediate the first cover 506 and the gear 542. The ratchet wheel 522 has (1) the splined inner circumference surface 522*a* and is received on the shaft splined portion 512, and (2) a toothed outer circumferential surface 522*b*. The ratchet wheel 522 is positioned on the shaft 510 proximate to the shaft first end 510*a*. A detent 546 is operatively received in the housing 504 such that one end of the detent 546 may be moved into and out of engagement with the ratchet wheel toothed outer circumferential surface 522*b* to prevent unwanted rotation of the ratchet wheel 522 in one direction.

A pin 545 is received through the detent 546 and is received in the housing body 504. The pin 545 allows the detent to pivot into an out of engagement with the ratchet wheel teeth 522*b*. A spring 547 mounted intermediate the housing body and the detent 546 biases the detent 546 radially inward toward the ratchet wheel 522 so that the detent 546 engages the ratchet wheel teeth 522*a* thereby preventing rotation of the ratchet wheel in the counterclockwise direction while allowing the ratchet wheel 522 to rotate in the clockwise direction. When the detent 546 is rotated outward, the detent 546 no longer engages with the ratchet wheel teeth 522*a* thereby allowing the ratchet wheel to rotate in both the clockwise and counterclockwise direction.

Clutch Mechanism

The clutch mechanism 548 is received on the shaft 510 adjacent the shaft second end 510*b*. The clutch 548 is also received in, and rotationally fixed to, the second cover 508. That is, the second cover 508 contains a substantially square recess that receives the substantially square clutch mechanism 548 so that the clutch mechanism is rotationally fixed to the second cover 508 and the housing 504. It should be understood that the clutch mechanism 548 may be rotationally fixed to the second cover 508 by other suitable means. The clutch 548 has a smooth, circular inner circumferential surface 550 for receiving the shaft second end 510*b*. In various embodiments, the clutch 548 is generally square shaped and made from friction-modifying materials (e.g., Kevlar, metal, alloy, semi-metallic material, sintered metal, resin, carbon material, or woven glass material).

Crank Shaft, Gear and Handle

Still referring to FIG. 20, the handle 500 is coupled to a first end 502*a* of the crank 502. In various embodiments, the crank 502 may be connected to the handle 500 using any suitable fastener (e.g., a bolt, a pin, a rivet, weldments, etc.). The crank 502 and the handle 500 are generally perpendicular to each other when attached. The crank 502 also has a second end 502*b* with an opening 502*c* that is configured to operatively engage with a gear crank shaft 511. The gear crank shaft 511 is rotationally fixed to the crank 502 since the shape of the crank opening 502*c* matches the shape of an end 511*a* of the gear crank shaft 511. That is, the crank opening 502*c* and the end 511*a* of the gear crank shaft 511 are both substantially square in shape. In various embodiments, the crank 502 may be coupled to the gear crank shaft 511 in any suitable manner (e.g., a bolt, a pin, a rivet, a cotter pin, weldments, etc.).

The gear crank shaft 511 is operatively coupled to a crank gear 513 so that the gear crank shaft is rotationally fixed to the crank gear 513. In various embodiments, the crank gear 513 is integrally formed with the gear crank shaft 511. In various other embodiments, the crank gear 513 may be connected to the gear crank shaft 511 using any suitable fastener (e.g., a bolt, a pin, a rivet, a cotter pin, weldments, etc.). The crank gear 513 has teeth that match the teeth of the gear 542.

Parts Enclosed Inside the Housing Body

Referring to FIG. 21, when the bowstring cocking device is assembled, the following parts fit inside the housing body 504 beginning at the first cover 506 and progressing along to the second cover 508: the ratchet wheel 522, the gear 542, the rope spool body 520, the disk 518, the splined ring 516, the clutch mechanism 548, the washer 523, the first spring 526, and the second spring 528 and running through the length of the inner circumference of each of these parts is the shaft 510.

Bowstring Cocking Device Operation

First Position

Figure 23:
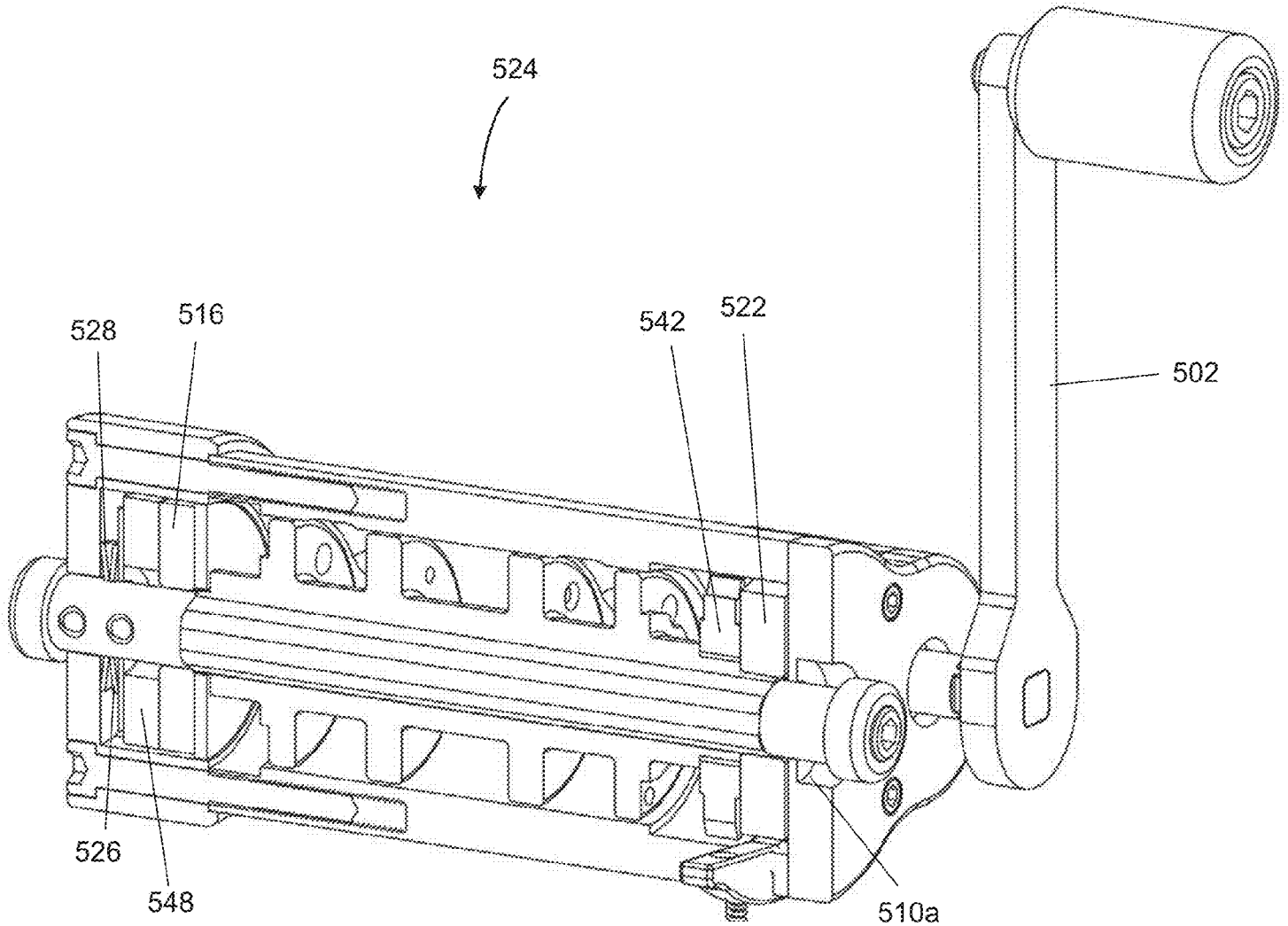
FIG. 23 is a partial perspective view of the bowstring cocking device of FIG. 20, in a first position.

Referring to FIGS. 21 and 23, the bowstring cocking device 524 is shown in a first position where the shaft 510 is moved axially into a first position with respect to the housing body 504 such that the splined portion 512 is engaged with the ratchet wheel splined inner circumferential surface 522*a* and is disengaged from the splined ring 516. In the first position, the splined ring 516 is positioned on the smooth surface of the shaft second end 510*b*. The bowstring cocking device 524 may be moved into the first position as shown in FIGS. 21 and 23 by pushing the second cap 515 axially toward to the first cover 506. Because the second cap 515 is coupled to the shaft 510, moving the second cap 515 axially toward the first cover 506 causes the shaft 510 to move axially (toward the right with regard to FIG. 21) so that the splined portion 512 engages with the inner circumferential splined surface 522*a* of the ratchet wheel 522, which causes the ratchet wheel 522 to be rotationally fixed with the shaft 510 while the splined ring 516 is allowed to rotate with respect to the shaft 510.

Referring again to FIG. 20, the teeth of the crank gear 513 engage with the teeth of the gear 542 so that rotation of the crank gear 513 in the clockwise direction causes the gear 542 to rotate in a counterclockwise direction (with respect to the view of FIG. 23). Thus when the crank 502 is turned clockwise, the gear crank shaft 511 also rotates clockwise in turn causing the crank gear 513 to rotate clockwise. This, in turn, rotates the gear 542 in the opposite, counter-clockwise, direction. Because the gear 542 is rotationally fixed to the shaft 510 via the spool body 520, and the ratchet wheel 522 and the spool body 520 are rotationally fixed to the shaft 510, rotation of crank 502 and crank shaft 511 clockwise causes the spool body 520 to rotate counterclockwise. As a result, as the rope spool body 520 rotates counterclockwise, it winds up the bowstring cocking rope 50 and pulls the bowstring 44 into the cocked position. Because the spring 547 biases the detent 546 into the ratchet wheel toothed outer circumferential surface 522*b*, the detent 546 prevents unwanted rotation of the ratchet wheel 522 in the clockwise direction. As a result, the spool body 520 is also prevented from rotating in the clockwise direction since the ratchet wheel 522 and the spool body 520 is rotationally fixed to the shaft 510. In this way, the spool body 520 will not inadvertently rotate clockwise in response to the bias exerted on the bowstring cocking rope 50 by the bowstring 44.

Second Position

Figure 22:
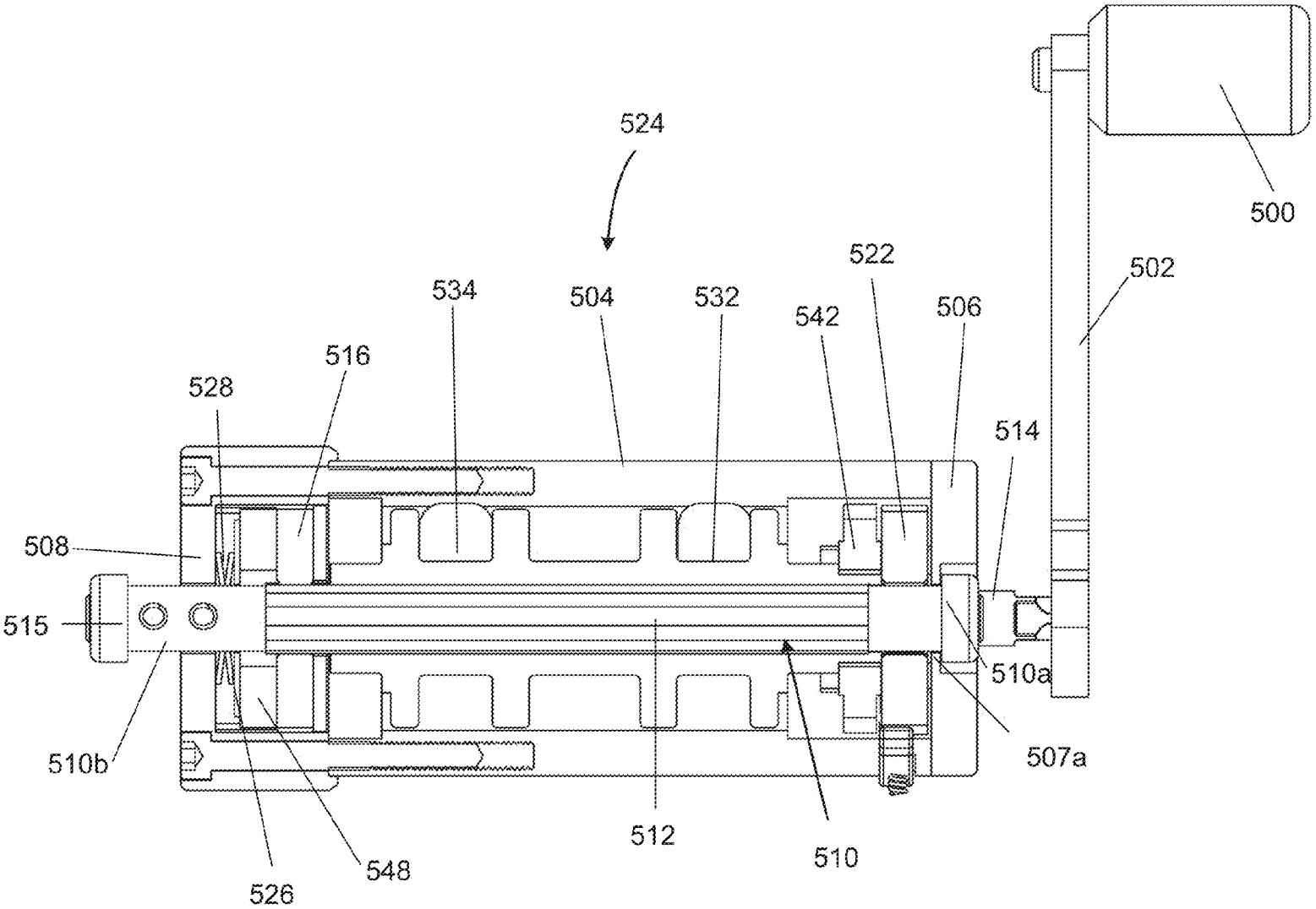
FIG. 22 is a partial sectional view of the bowstring cocking device of FIG. 20, in a second position.
Figure 24:
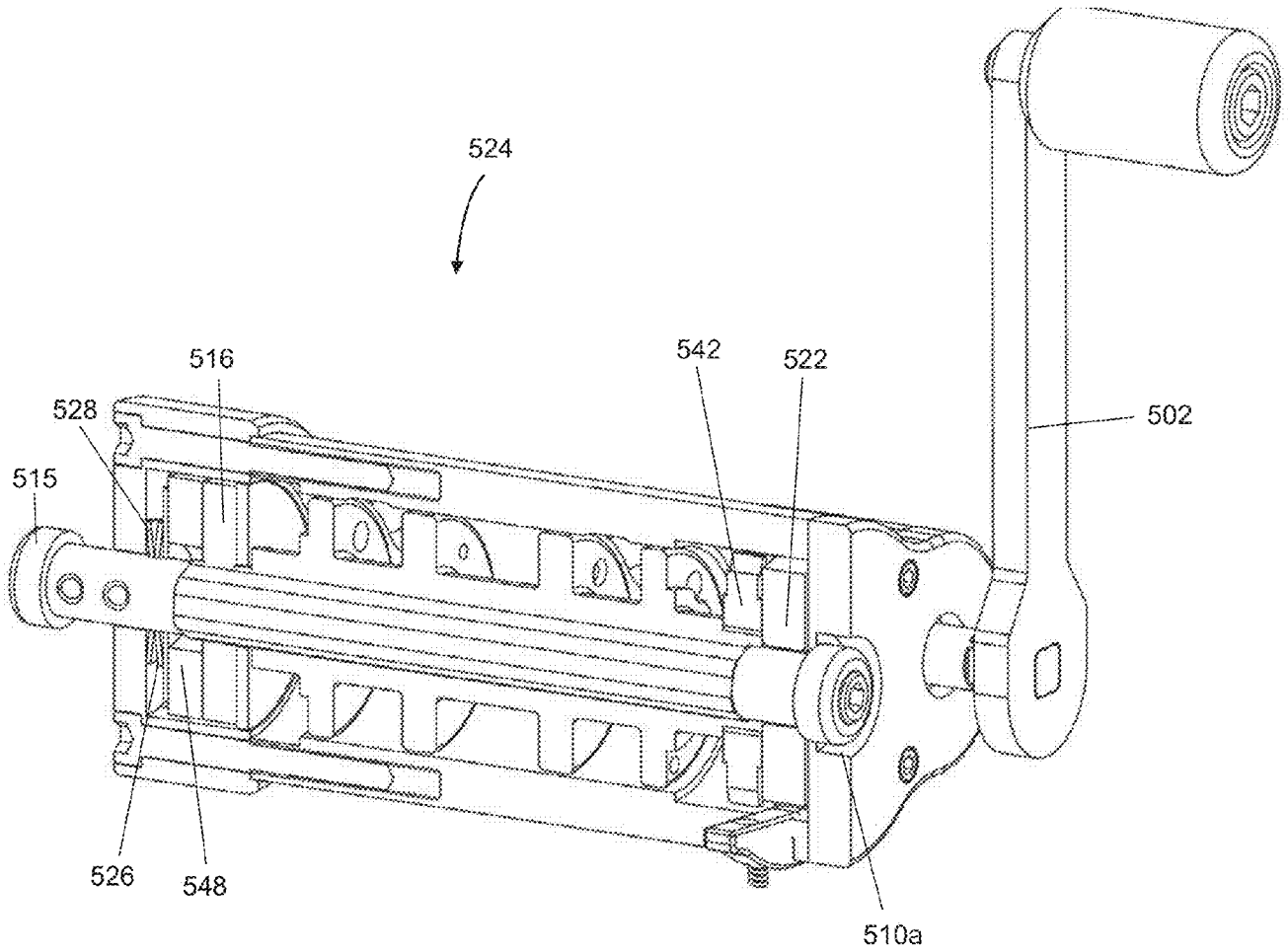
FIG. 24 is a partial perspective view of the bowstring cocking device of FIG. 20, in a second position.

FIGS. 22 and 24 show the shaft 510 in a second position where the shaft splined portion 512 is disengaged from the ratchet wheel 522 and is engaged with the splined ring 516. In the second position, either the bowstring cocking rope 50 may be slightly released so that the first and second hooks 50*a* and 50*b* may be removed from the bowstring 44 once the bowstring is in the cocked portion, or (2) the bowstring 44 may be moved from the firing position into the resting position without firing or dry firing the crossbow 10. The bowstring cocking device is moved into the second position when the user pushes the first cap 514 axially away from the first cover 506, causing the shaft 510 to move axially rearward (e.g., to the left in FIG. 22) so that the shaft splined portion 512 engages the splined ring 516 and disengages from the splined ratchet wheel 522. Because the inner circumference of the first cover second hole 507*a* is larger than the outer circumference of the shaft first end 510*a* but smaller than the outer circumference of the first cap 514, the shaft moves axially through the second hold 507*a* and the first cap 514 functions as a stop to prevent the user from pushing the first cap 514 through the first cover 506.

Thus, when the bowstring cocking device 524 is in the second position, the ratchet wheel 522 no longer prevents the shaft 510 from rotating in the clockwise direction since the ratchet wheel 522 is no longer rotationally fixed to the shaft 510. Instead, the engagement of a face of the splined ring 516 with a face of the clutch mechanism 548 prevents the shaft 510 from spinning freely. That is, the frictional force between the face of the splined ring 516 and the corresponding face of the clutch mechanism 548 is greater than the pulling force exerted on the bowstring cocking rope 50 by the bowstring 44. As a result, the shaft remains rotationally fixed to the housing through the clutch mechanism 548 until the user exerts sufficient force on the shaft to overcome the frictional force by turning the handle 500 and the crank 502 in the counterclockwise direction, which in turn causes the shaft 510 to rotate in the clockwise direction, thereby letting the bowstring cocking rope 50 out from the rope spools 532, 534. In this way, the user can either release tension on the bowstring cocking rope to allow the user to remove the first and second hooks 50*a* and 50*b* (not shown) from the bowstring 44 or to release the bowstring 44 from the cocked position into the resting position in a controlled manner without firing or dry firing the crossbow.

Fourth Embodiment of Bowstring Cocking Device

Figure 25:
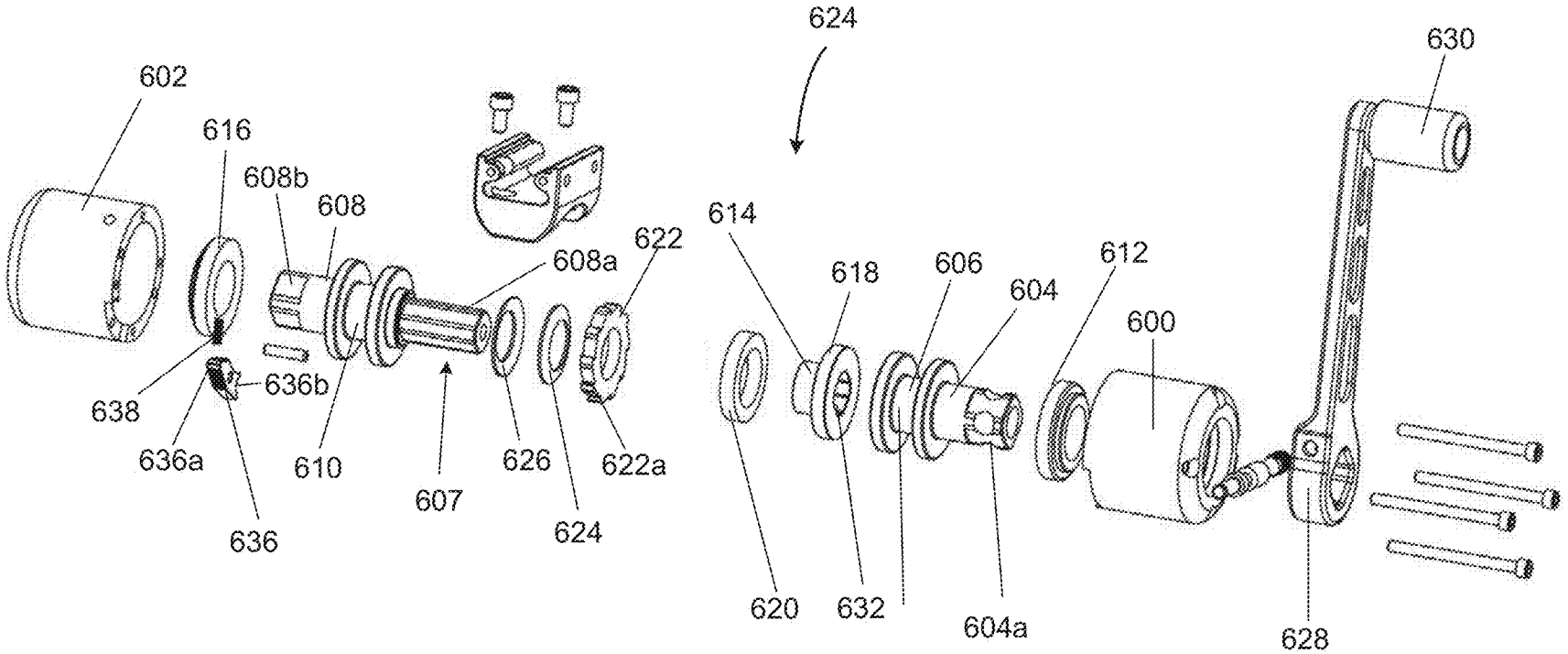
FIG. 25 is an exploded view of an embodiment of a bowstring cocking device for use in the crossbow of FIG. 1.
Figure 27:
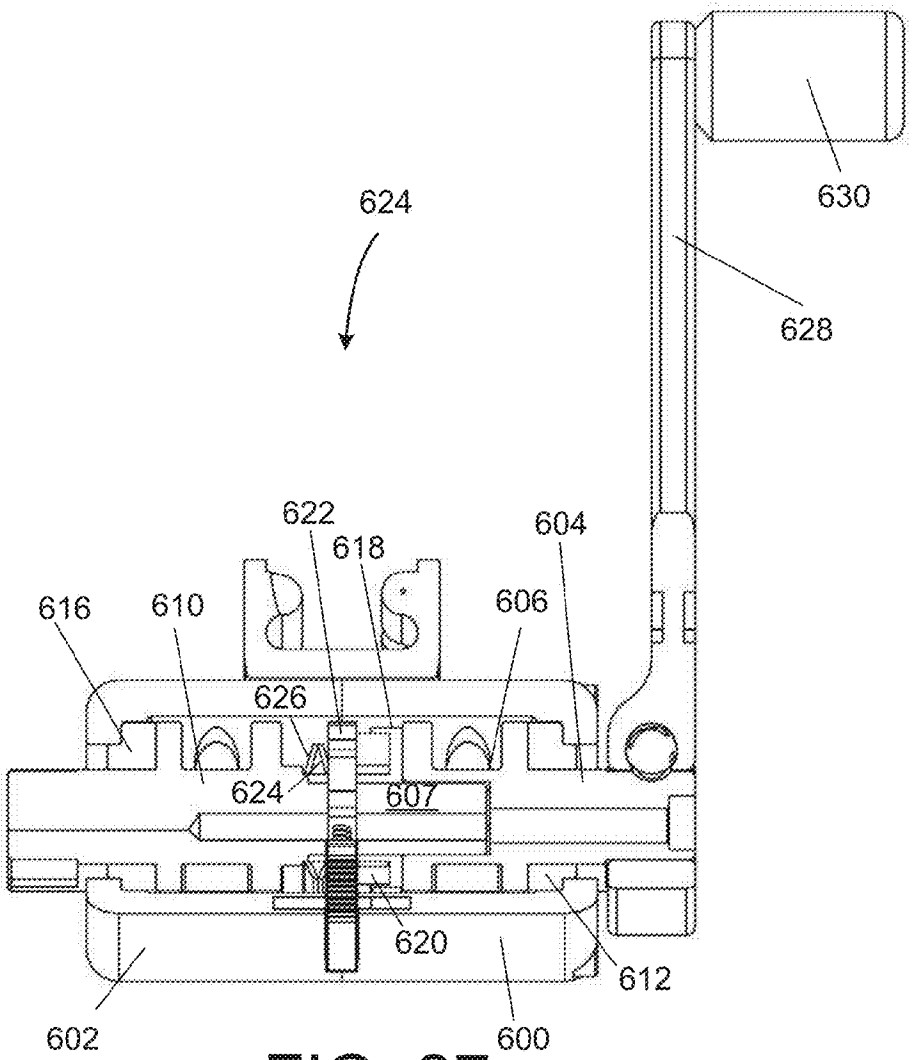
FIG. 27 is partial sectional view of the bowstring cocking device of FIG. 25.
Figure 26:
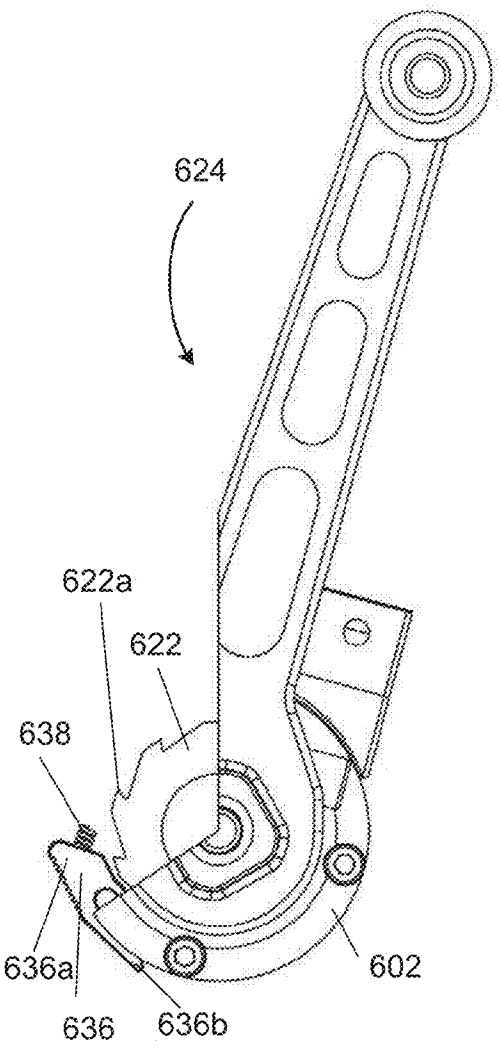
FIG. 26 is a partial sectional view of the bowstring cocking device of FIG. 25.

FIGS. 25-27 illustrate an embodiment of a bowstring cocking device 624 that is similar to the bowstring cocking device 424 of FIGS. 18-19. For purposes of ease of understanding and clarity, only certain parts will be discussed to highlight the differences in the structure and operation of the embodiment shown in FIGS. 25-27 as compared to the embodiment shown in FIGS. 18-19. Referring particularly to FIG. 25, the bowstring cocking device 624 contains a first housing body 600, a second housing body 602, a first rope spool body 604 having a first substantially square shaped end 604*a* and a first rope spool 606. The bowstring cocking device 624 also contains a second rope spool body 608 having (1) a first generally rectangular shaped end 608*a*, (2) a second generally square shaped end 608*b*, and (3) a second rope spool 610 formed thereon intermediate the shaft first and second ends 608*a*, 608*b*. Together, the first and second rope spool bodies form a shaft 607 that comprises the first rope spool body 604 and the shaft first and second ends 608*a* and 608*b*. Similar to the bowstring cocking device 424, a first and a second bearing 612 and 616 are respectively received on the first and second rope spool bodies 604, 608 to allow the rope spool bodies 604, 608 to rotate with respect to the housing bodies 600, 602, respectively. A sleeve 614 attached to a ring 618 are rotationally fixed to the second rope spool body first end 608*a*, as described below. A clutch mechanism 620, a ratchet wheel 622, a first spring 624 and a second spring 626 are received on, and is rotatable with respect to the sleeve 614 and sleeve ring 618. A crank 628 (1) is rotationally fixed to the first rope spool body first end 604*a* and (2) has a handle 630 rotatably coupled thereto by a suitable fastener.

Sleeve

Still referring to FIG. 25, the sleeve 614 and sleeve ring 618 are rotationally fixed to the second rope spool body 608 since the sleeve 618 contains a generally square opening 632 that is configured to receive the generally square shaped second rope spool body first end 608*a* therein. At the end of the sleeve 614 proximate to the first rope spool 606 is the sleeve disk 618 that is rotationally fixed to the sleeve 614. In various embodiments, the sleeve disk 618 is integrally formed with the sleeve 614. In still other embodiments, the sleeve disk 618 may be formed separately from the sleeve 614 and fastened to the sleeve 614 using any suitable fastener such as pins, rivets, screws, weldments, etc.

Clutch, Springs, and Ratchet Wheel

Encircling the sleeve 618 is the clutch mechanism 620, the ratchet wheel 622, the first spring 624 and the second spring 626. The ratchet wheel 622 has a toothed outer circumference 622*a*. The clutch mechanism 620 is positioned intermediate the sleeve disk 618 and the ratchet wheel 622. The ratchet wheel 622 is positioned intermediate the sleeve disk 618 and the first spring 624. The first spring 624 is positioned intermediate the ratchet wheel 622 and the second spring 626. And the second spring 626 is positioned intermediate the first spring 624 and the second rope spool 610. The clutch mechanism 620 is generally circular in shape and made from friction-modifying materials (e.g., Kevlar, metal, alloy, semi-metallic material, sintered metal, resin, carbon material, or woven glass material). The first spring 624 is concave towards the second spring 626, while the second spring 626 is concave towards the first spring 624.

Detent

Referring to FIG. 26, a detent 636 is received through the second housing body 602 and engages with a spring 638 at the bottom of the second housing body 602. The spring 638 biases a first end 636*a* of the detent 636 radially outward which in turn causes the second end 636*b* of the detent 636 to move radially inward toward the ratchet wheel 622 so that the detent second end 636*b* engages the ratchet wheel teeth 622*a* thereby preventing rotation of the ratchet wheel 622 in the counterclockwise direction while allowing the ratchet wheel 622 to rotate in the clockwise direction. When the detent first end 636*a* is pushed radially inward against the bias of the spring 638, the detent second end 636*b* moves radially outward so that it no longer engages with the ratchet wheel teeth 622*a* thereby allowing the ratchet wheel 622 to rotate in both the clockwise and counterclockwise direction.

Bowstring Cocking Device Operation

Referring to FIG. 27, the bowstring cocking device 624 is used to pull the bowstring 44 of the crossbow 10 into a cocked position by turning the shaft 607 in the clockwise direction using the handle 630 and crank 628. As the shaft 607 rotates, the ratchet wheel 622 also rotates in the clockwise direction since it is rotationally fixed to the shaft 607 via the clutch mechanism 620 and the sleeve disk 618. As a result, as the ratchet wheel 622 rotates in the clockwise direction, the detent second end 638*b* pops over the ratchet wheel teeth 622*a*. Once the bowstring is moved into the cocked position, the user may rotate the shaft 607 in the counterclockwise direction by applying rotational force to the shaft 607 via the crank 628 and handle 630. That is, the rotational force applied by the user is sufficient to overcome the frictional force between the ratchet wheel 622, the sleeve disk 618 and the clutch mechanism 620. Thus, the user can place slack in the bowstring cocking rope 50 to allow the first and second hooks 50*a* and 50*b* to be removed from the bowstring 44. Once the first and second hooks are removed from the bowstring 44, the user may rotate the shaft 607 in the clockwise direction once again to take up any remaining bowstring cocking rope 50 so that the first and second hooks 50*a* and 50*b* are positioned adjacent the housing bodies 600, 602. Once the crossbow 10 is fired, the user may push the detent first end 636*a* so that the detent second end 636*b* moves out of engagement with the ratchet wheel teeth 622*a* so that the first and second hooks 50*a* and 50*b* may be easily pulled from the housing bodies 600, 602 and hooked onto the bowstring 44.

If the user wishes to move the bowstring 44 from a cocked position into an un-cocked position, the user may simply apply rotational force to the shaft 607 in the counterclockwise direction so that bowstring cocking rope 50 is wound off the first and second rope spools 606 and 610. Rotation of the shaft 607 in the counterclockwise direction is controlled by the frictional forces that are exerted between the clutch mechanism 620 and the sleeve disk 618 and the frictional forces that are exerted between the clutch mechanism 620 and the ratchet wheel 622. Thus, if the user releases the handle 630, the shaft 607 will not spin out of control due to the pulling forces exerted on the shaft 607 by the bowstring 44.

It should be understood to one of skill in the art that by placing the ratchet wheel, the clutch mechanism and the sleeve disk intermediate the first and second spools, the overall size of the bowstring cocking device can be reduced.

Bowstring Cocking Device Alternate Embodiment

Figure 28:
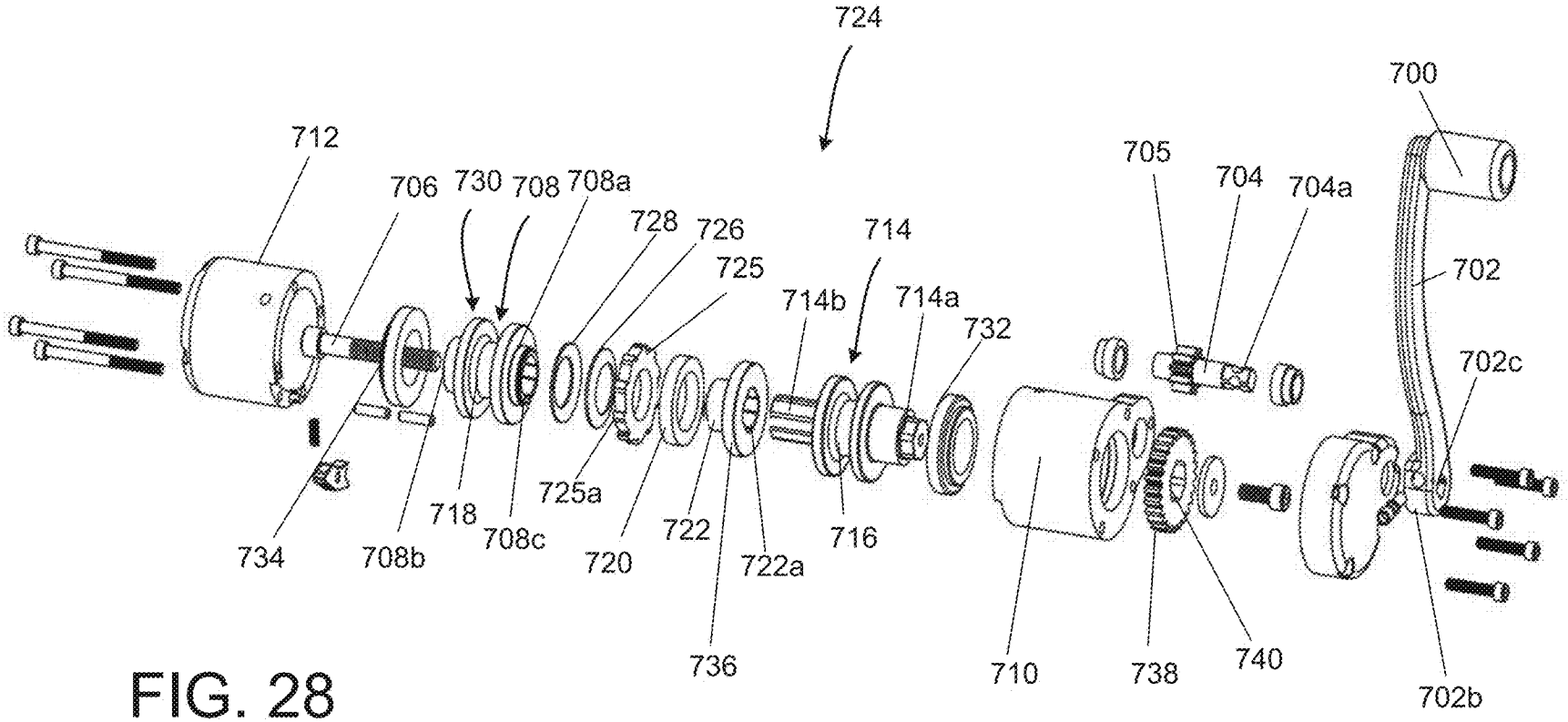
FIG. 28 is an exploded view of an embodiment of a bowstring cocking device for use in the crossbow of FIG. 1.
Figure 30:
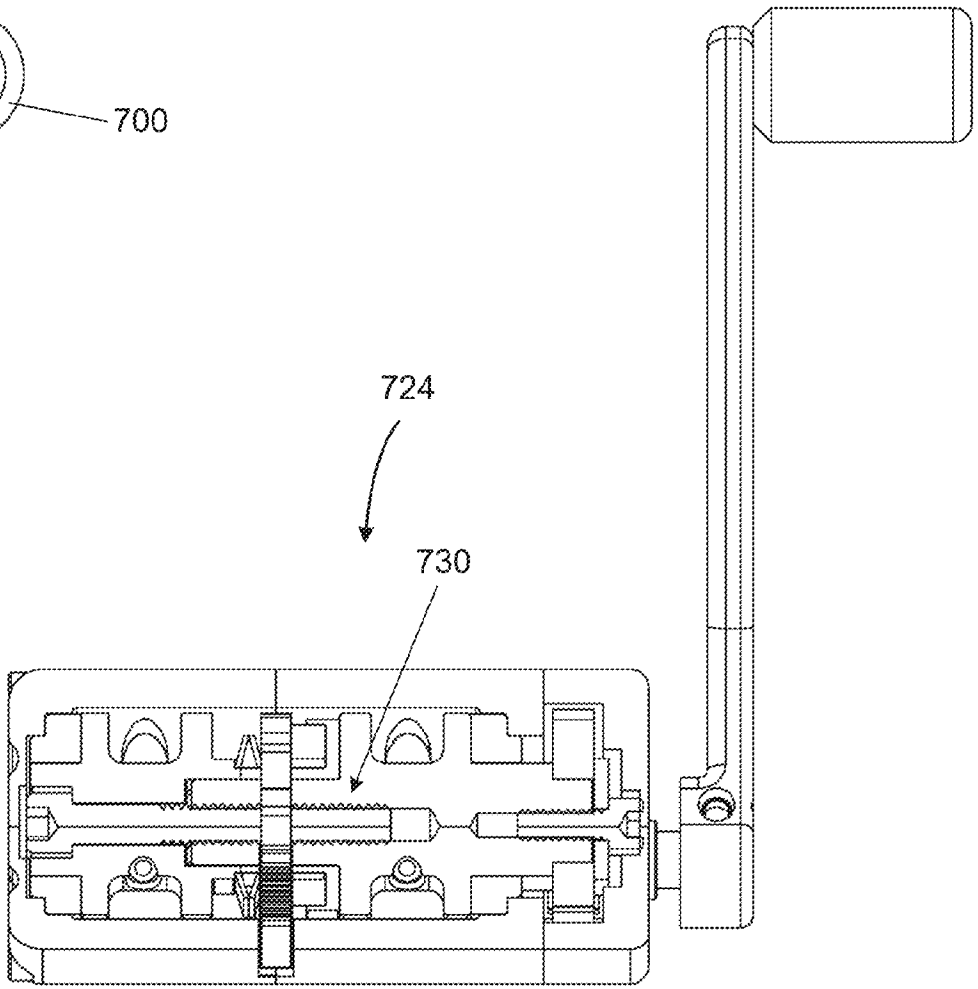
FIG. 30 is partial sectional view of the bowstring cocking device of FIG. 28.
Figure 29:
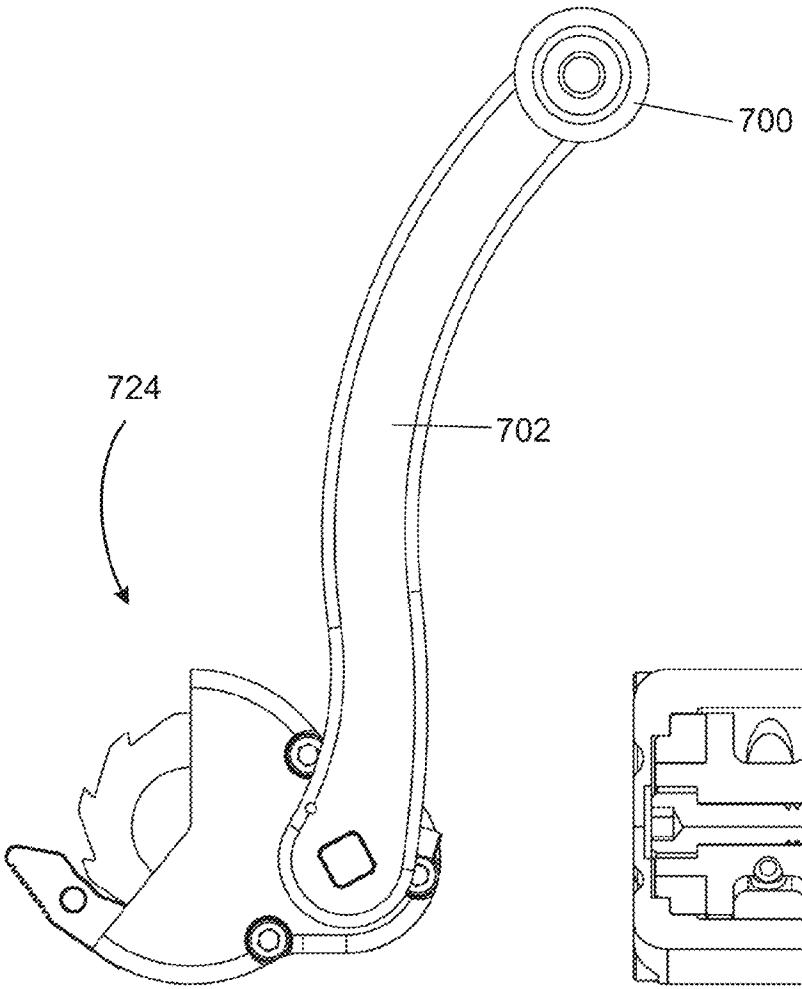
FIG. 29 is a partial sectional view of the bowstring cocking device of FIG. 28.

Referring to FIGS. 28-30 an alternative embodiment of a bowstring cocking device 724 is shown having a dual shaft design as opposed to the single shaft design shown in the bowstring cocking device 624 embodiment of FIGS. 25-27. Thus, for purposes of ease of understanding and clarity, only certain parts will be discussed to highlight the differences in the structure and operation of the embodiment shown in FIGS. 28-30 as compared to the embodiment shown in FIGS. 25-27.

Handle and Crank

The handle 700 and crank shaft 702 are coupled to a gear shaft 704. That is, the crank second end 702*b* contains a square opening 702*c* that mates with, and is rotationally fixed to, a first end 704*a* of the shaft 704. Additionally, this alternate embodiment utilizes a bolt that runs the length of the second rope spool body 708 that is used to secure the second rope spool body to the first rope spool body.

Housing Bodies and Rope Spool Bodies

The bowstring cocking device 724 contains a first housing body 710, a second housing body 712, a first rope spool body 714 having a first substantially square shaped end 714*a*, a second substantially square shaped end 714*b*, and a first rope spool 716. The bowstring cocking device 724 also contains the second rope spool body 708 having a first end 708*a* and a second end 708*b*, and having a second rope spool 718 formed thereon intermediate the second rope spool body first and second ends 708*a*, 708*b*. The second rope spool body 708 has a generally square shaped inner circumference 708*c*. The first rope spool body second end 714*b* is received by the second rope spool body inner circumference 708*c* so that the first and second rope spool bodies are rotationally fixed to one another. Also received on the first rope spool body second end 714*b* is a clutch mechanism 720, a sleeve 722, a ratchet wheel 725, a first spring 726, and a second spring 728. When the first rope spool body second end 714*b* is received in the second rope spool body inner circumference 708*c*, the first and second rope spool bodies together define a shaft 730. Similar to the bowstring cocking device 624, first and second bearings 732, 734 are received on the first and second rope spool bodies 714, 708 to allow the rope spool bodies 714, 708 to rotate with respect to the housing bodies 710, 712.

Sleeve

As shown in FIG. 25, the sleeve 722 is rotationally fixed to the first rope spool body 714 since the sleeve 722 contains a generally square opening 722*a* that is configured to receive the square first rope spool body first end 714*b* therein. At the end of the sleeve 722 intermediate the clutch mechanism 720 and the ratchet wheel 725 is a sleeve disk 736 that is rotationally fixed to the sleeve 722. The ratchet wheel 725, and the first and second springs 726, 728 are received on, and rotatable with respect to the sleeve 722. In various embodiments, the sleeve disk 736 is integrally formed with the sleeve 722. In still other embodiments, the sleeve disk 736 may be formed separately from the sleeve 722 and fastened to the sleeve 722 using any suitable fastener such as pins, rivets, screws, weldments, etc.

Clutch, Springs, and Ratchet Wheel

Encircling the first spool body second end 714*b* is the sleeve disk 736 and the sleeve 722.

The clutch 720 and the ratchet wheel 725 are received on the sleeve 722. That is, the clutch 720 is positioned intermediate the sleeve disk 736 and the ratchet wheel. Also encircling the sleeve 722 is the first spring 726 and the second spring 728, which are positioned intermediate the second rope spool body 708 and the ratchet wheel 725. The ratchet wheel 725 has a toothed outer circumference 725*a*. The clutch mechanism 720 is generally circular in shape and made from friction-modifying materials (e.g., Kevlar, metal, alloy, semi-metallic material, sintered metal, resin, carbon material, or woven glass material). The first spring 726 is concave towards the second spring 728, while the second spring 728 is concave towards the first spring 726.

Gear, Crank Gear, and Crank Gear Shaft

Still referring to FIG. 28, the crank second end opening 702*c* is configured to operatively engage with a gear crank shaft 704. The gear crank shaft 704 is rotationally fixed to the crank 702 since the shape of the crank opening 702*c* matches the shape of an end 704*a* of the gear crank shaft 704. That is, the crank opening 702*c* and the gear crank shaft end 704*a* are both substantially square in shape. In various embodiments, the crank 702 may be coupled to the gear crank shaft 704 in any suitable manner (e.g., a bolt, a pin, a rivet, a cotter pin, weldments, etc.).

The gear crank shaft 704 is operatively coupled to a crank gear 705 so that the gear crank shaft 704 is rotationally fixed to the crank gear 705. In various embodiments, the crank gear 705 is integrally formed with the gear crank shaft 704. In various other embodiments, the crank gear 705 may be connected to the gear crank shaft 704 using any suitable fastener (e.g., a bolt, a pin, a rivet, a cotter pin, weldments, etc.). The crank gear 705 has teeth that match the teeth of a gear 738. The gear 738 has a substantially square inner circumference to receive the first rope spool body first end 714*a* so that the first rope spool body 714 is rotationally fixed to the gear 738.

Bowstring Cocking Device Operation

Referring to FIG. 29, the bowstring cocking device 724 is used to pull the bowstring 44 of the crossbow 10 (FIG. 1) into a cocked position by turning the crank shaft 702 in the clockwise direction using the handle 700. Referring again to FIG. 28, the teeth of the crank gear 705 engage with the teeth of the gear 738 so that rotation of the crank gear 705 in the clockwise direction (with respect to FIG. 29) causes the gear 738 to rotate in a counterclockwise direction. Thus when the crank 702 is turned clockwise, the gear crank shaft 704 also rotates clockwise in turn causing the crank gear 705 to rotate clockwise. This, in turn, rotates the gear 738 in the opposite, counter-clockwise, direction. Because the gear 738 is rotationally fixed to the first rope spool body 714 and the second rope spool body 708 is rotationally fixed to the first rope spool body 714, rotation of the crank 702 and the gear crank shaft 704 clockwise causes the first and second spool bodies 714, 708 to rotate counterclockwise. As a result, as the rope spool bodies 714, 708 rotate counterclockwise, they wind up the bowstring cocking rope 50 and pull the bowstring 44 into the cocked position. The overall operation of the bowstring cocking device 724 is substantially similar to the bowstring cocking device 624 and a detailed description is omitted for brevity.

Conclusion

In all of the various embodiments described above, various clutch mechanism are used to control the rotation of a shaft in a bowstring cocking device. As such, frictional forces between a disk that is rotationally fixed to the shaft and a clutch mechanism that is either (1) rotationally fixed to a housing body or (2) positioned intermediate to a ratchet wheel and a disk rotationally fixed to the shaft help to control the rotation of the shaft when force is exerted on the shaft by the bowstring. The various configurations also allow the user to either (1) provide slack in the bowstring cocking rope so that the user can remove the hooks connecting the bowstring cocking rope to the bowstring, or (2) move the bowstring from a cocked position into an un-cocked position without the user firing or dry firing the crossbow.

What is claimed:

1. A bowstring drawing mechanism for use on a weapon comprising:

a. a generally cylindrical housing;

b. a shaft having:

i. a first end, ii. a second end, iii. an axis extending between the first and second ends, and iv. axial splines formed on an outer circumference of the shaft intermediate the first and second ends, wherein each axial spline is substantially parallel to the shaft axis, wherein a portion of the shaft is rotatably mounted in the housing;

c. a ratchet wheel having a toothed outer circumferential surface and a splined inner circumferential surface, the ratchet wheel being positioned on the shaft proximate the shaft first end;

d. at least one rope spool received on, axially moveable with respect to, and rotationally fixed to, the shaft, wherein the at least one rope spool is configured to attach to a first and a second end of a rope that is configured to be releasably attached to a bowstring;

e. a clutch mechanism received on the shaft intermediate the shaft second end and the shaft axial splines, wherein the clutch mechanism has splines formed on an inner circumferential surface; and f. a handle operatively coupled to the shaft;

wherein when the shaft is in a first axial position, with respect to the clutch mechanism and the ratchet wheel, the shaft splines are engaged with the ratchet wheel splines and are disengaged from the clutch mechanism splines so that the ratchet wheel allows the shaft to rotate in a first direction and prevents the shaft from rotating in a second opposite direction, and when the shaft is in a second axial position, with respect to the clutch mechanism and the ratchet wheel, the shaft splines are disengaged from the ratchet wheel splines and engaged with the clutch mechanism splines so that the clutch mechanism prevents the shaft from rotating in the first direction and the second direction until force is applied to the handle.

2. The bowstring drawing mechanism of claim 1, wherein the clutch mechanism comprises a first ring having the axial splines formed on an inner circumferential surface and a clutch plate that is rotationally fixed to the housing, wherein a surface of the first ring engages a surface of the clutch plate.

3. The bowstring drawing mechanism of claim 2, wherein the clutch plate is formed from one or more materials selected from a group consisting of:

a. Kevlar;

b. metal;

c. alloy;

d. semi-metallic material;

e. sintered metal;

f. resin;

g. carbon material; and h. woven glass material.

4. The bowstring drawing mechanism of claim 2, wherein the surface of the ring has radial teeth formed thereon and the surface of the clutch plate has radial teeth formed thereon, wherein the ring radial teeth engage with the clutch plate radial teeth.

5. The bowstring drawing mechanism of claim 1, further comprising:

a. a first gear operatively coupled to the shaft;

b. a second shaft rotatably mounted at least partially in the housing and having a second gear operatively coupled to the second shaft;

wherein i. the first gear is operatively coupled to the second gear;

ii. the handle is operatively coupled to the second shaft;

iii. movement of the handle in a first direction causes the shaft to rotate in the second direction and movement of the handle in the second direction causes the shaft to rotate in the first direction.

6. The bowstring drawing mechanism of claim 1, further comprising:

a. an elongated body having an elongated body first end and an elongated body second end;

b. a first limb coupled to the elongated body first end;

c. a second limb coupled to the elongated body first end;

d. a bowstring having a bowstring first end operatively coupled to the first limb and a bowstring second end operatively coupled to the second limb; and e. a trigger mechanism coupled to the elongated body intermediate the elongated body first and second ends, wherein the housing is operatively coupled to the elongated body.

7. The bowstring drawing mechanism of claim 1, further comprising a rope having a. a first end and a second end each respectively coupled to the at least one rope spool; and b. a first and second hook operatively coupled to the rope intermediate the first and second rope ends, wherein when the shaft is rotated in the first direction, the rope winds around the at least one rope spool, when the shaft is rotated in the second direction, the rope is let out from the at least one rope spool, and the hooks are configured to releasably attach to the bowstring.

8. The bowstring drawing mechanism of claim 1, further comprising a threaded knob that is received on a threaded portion of the second end of the shaft, wherein rotation of the knob causes the shaft to move between the first and second positions.

9. A bowstring drawing mechanism comprising:

a. a generally cylindrical housing having a first end and a second end;

b. a shaft rotatably mounted in the housing and having:

i. a first end that at least partially extends through the housing first end, and ii. a second end, c. at least one rope spool received on, and rotationally fixed to, the shaft intermediate the shaft first and second ends, wherein the at least one rope spool is configured to attach to a first and a second end of a rope that is configured to be releasably attached to a bowstring;

d. a handle operatively coupled to the shaft; and e. a clutch mechanism received on the shaft, wherein the clutch mechanism is configured to at least temporarily rotationally fix the shaft to the housing to prevent the shaft from rotating in a first direction and an opposite second direction until a force is exerted on the handle to overcome the frictional forces introduced by the clutch mechanism.

10. The bowstring drawing mechanism of claim 9, wherein:

a. the clutch mechanism is positioned on the shaft intermediate the rope spool and the shaft first end;

b. when a portion of the clutch mechanism is in a first axial position on the shaft, the clutch mechanism prevents the shaft from rotating in the first direction and the second direction; and c. when the portion of the clutch mechanism is in a second axial position, the clutch mechanism allows the shaft to rotate in one of the first and second directions.

11. The bowstring drawing mechanism of claim 10, further comprising at least one spring received on the shaft intermediate the clutch mechanism and the housing first end, wherein the at least one spring biases the clutch mechanism into the first axial position.

12. The bowstring drawing mechanism of claim 11, wherein the clutch mechanism further comprises:

a. a disk rotationally fixed to, and axially moveable with respect to, the shaft;

b. a clutch plate rotationally fixed to the housing and rotatable with respect to the shaft, wherein i. the handle is rotationally fixed to the disk;

ii. the disk is axially moveable with respect to the shaft as the handle is pulled away from the housing first end against the bias of the at least one spring, and iii. a radial surface of the disk engages with a radial surface of the clutch plate when the clutch is in the first axial position.

13. The bowstring drawing mechanism of claim 12, wherein the clutch plate is formed from one or more materials selected from a group consisting of:

a. Kevlar;

b. metal;

c. alloy;

d. semi-metallic material;

e. sintered metal;

f. resin;

g. carbon material; and h. woven glass material.

14. The bowstring drawing mechanism of claim 12, wherein the radial surface of the ring has radial teeth formed thereon and the radial surface of the clutch plate has radial teeth formed thereon, wherein the ring radial teeth engage with the clutch plate radial teeth to prevent the ring from rotating in the first and second directions.

15. The bowstring drawing mechanism of claim 12, further comprising:

a. an elongated body having an elongated body first end and an elongated body second end;

b. a first limb coupled to the elongated body first end;

c. a second limb coupled to the elongated body first end;

d. a bowstring having a bowstring first end operatively coupled to the first limb and a bowstring second end operatively coupled to the second limb; and e. a trigger mechanism coupled to the elongated body intermediate the elongated body first and second ends, wherein the housing is operatively coupled to the elongated body.

16. The bowstring drawing mechanism of claim 9, further comprising:

a. axial splines formed on the outer circumference of the shaft intermediate the shaft first end and the shaft thread; and b. a ratchet wheel having a toothed outer circumferential surface and a splined inner circumferential surface, the ratchet wheel being positioned on the shaft intermediate the shaft first end and the shaft splines;

wherein i. the at least one rope spool is axially moveable with respect to the shaft, ii. the clutch mechanism is positioned on the shaft intermediate the shaft thread and the shaft axial splines, iii. the clutch mechanism has splines formed on an inner circumferential surface;

iv. when the shaft is in a first axial position, with respect to the clutch mechanism and the ratchet wheel, the shaft splines are engaged with the ratchet wheel splines and are disengaged from the clutch mechanism splines so that the ratchet wheel allows the shaft to rotate in a first direction and prevents the shaft from rotating in a second opposite direction, and v. when the shaft is in a second axial position, with respect to the clutch mechanism and the ratchet wheel, the shaft splines are disengaged from the ratchet wheel splines and engaged with the clutch mechanism splines so that the clutch prevents the shaft from rotating in the first direction and the opposite second direction until force is applied to the handle.

17. The bowstring drawing mechanism of claim 16, further comprising a threaded knob that is in threaded engagement with a thread formed on the second end of the shaft, wherein rotation of the knob with respect to the shaft causes the shaft to move between the shaft first and second positions.

18. The bowstring drawing mechanism of claim 9, further comprising:

a. a ratchet wheel positioned intermediate the clutch mechanism and the handle; and b. at least one spring positioned intermediate the ratchet wheel and the housing, wherein i. the clutch mechanism further comprises:

a disk rotationally fixed to the shaft, and a clutch plate that is rotatable with respect to the disk, ii. the ratchet wheel is rotatable with respect to the shaft;

iii. the at least one spring biases the ratchet wheel against the clutch plate so that the disk and clutch plate rotationally fix the ratchet wheel to the shaft.

19. The bowstring drawing mechanism of claim 18, further comprising a detent operatively coupled to the housing and moveable between:

a. a first position in which the detent engages the ratchet wheel and allows the shaft to rotate in the first direction and rotationally fixes the shaft in the second direction; and b. a second position in which the detent disengages the ratchet wheel so that the shaft may rotating in one of the first and the second directions when force is applied to the handle.

20. A bowstring drawing mechanism comprising:

a. a generally cylindrical housing having a first end and a second end;

b. a shaft rotatably mounted in the housing and having:

i. a first end that at least partially extends through the housing first end, and ii. a second end, c. a first rope spool received on, and rotationally fixed to, the shaft intermediate the shaft first and second ends, d. a second rope spool received on, and rotationally fixed to, the shaft intermediate the first rope spool and the shaft second end;

e. a handle operatively coupled to the shaft; and f. a clutch mechanism received on the shaft intermediate the first and second rope spools, wherein:

i. the first and second rope spools are configured to respectively attach to a first and a second end of a rope that is configured to be releasably attached to a bowstring; and ii. the clutch mechanism is configured to at least temporarily rotationally fix the shaft to the housing to prevent the shaft from rotating in a first direction and an opposite second direction until a force is exerted on the handle to overcome the frictional forces introduced by the clutch mechanism.

21. The bowstring drawing mechanism of claim 20, wherein the clutch mechanism further comprises:

a. a disk rotationally fixed to the shaft;

b. a ratchet wheel rotatably received on the shaft; and c. a clutch plate positioned intermediate the disk and the ratchet wheel.

22. The bowstring drawing mechanism of claim 21, further comprising a detent operatively coupled to the housing, wherein the detent has a first end that operatively engages with the ratchet wheel to allow the shaft to rotate in a first direction and prevent the shaft from rotating in the opposite second direction.

23. The bowstring drawing mechanism of claim 20, further comprising:

a. a first gear received on and rotationally fixed to the shaft;

b. a second shaft rotatably mounted in the housing, the second shaft having:

i. a first end coupled to the handle; and ii. a second gear rotationally fixed to the second shaft; and wherein, the first gear is operatively coupled to the second gear so that rotation of the handle in a first direction causes the second shaft and the second gear to rotate in the first direction and the first gear and the first shaft to rotate in the opposite direction.

24. The bowstring drawing mechanism of claim 20, further comprising:

a. an elongated body having an elongated body first end and an elongated body second end;

b. a first limb coupled to the elongated body first end;

c. a second limb coupled to the elongated body first end;

d. a bowstring having a bowstring first end operatively coupled to the first limb and a bowstring second end operatively coupled to the second limb; and e. a trigger mechanism coupled to the elongated body intermediate the elongated body first and second ends, wherein the housing is operatively coupled to the elongated body.

25. The bowstring drawing mechanism of claim 20, wherein the generally cylindrical housing comprises a first housing portion and a second housing portion.

* * * * *